US012559945B2

(12) United States Patent
Majocka et al.

(10) Patent No.: US 12,559,945 B2
(45) **Date of Patent: *Feb. 24, 2026**

(54) DOMED OR RAISED DRAIN INLET STRAINERS

(71) Applicant: Zurn Water, LLC, Milwaukee, WI (US)

(72) Inventors: Christopher Alan Majocka, Erie, PA (US); Matthew Curtis Henderson, Girard, PA (US); Christopher Joseph Say, Waterford, PA (US)

(73) Assignee: ZURN WATER, LLC, Milwaukee, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/665,453

(22) Filed: May 15, 2024

(65) Prior Publication Data

US 2024/0301697 A1 Sep. 12, 2024

Related U.S. Application Data

(63) Continuation of application No. 17/192,688, filed on Mar. 4, 2021, now Pat. No. 12,018,489.

(60) Provisional application No. 63/009,894, filed on Apr. 14, 2020.

(51) Int. Cl.
*E04D 13/04* (2006.01)

(52) U.S. Cl.
CPC .. *E04D 13/0409* (2013.01); *E04D 2013/0413* (2013.01)

(58) Field of Classification Search
None
See application file for complete search history.

(56) References Cited

U.S. PATENT DOCUMENTS

| | | | | |
|---|---|---|---|---|
| 60,153 A | | 12/1866 | Peters | |
| 134,978 A | | 1/1873 | Clapp | |
| 149,489 A | | 4/1874 | Lewis | |
| 231,480 A | | 8/1880 | Downes | |
| 528,888 A | * | 11/1894 | Mcgill | E02B 11/005 210/166 |
| 534,718 A | * | 2/1895 | Johns | E03C 1/262 4/287 |
| 550,460 A | | 11/1895 | Shanks | |

(Continued)

FOREIGN PATENT DOCUMENTS

| | | |
|---|---|---|
| AT | 224330 B | 11/1962 |
| CA | 3113904 A1 | 10/2021 |

(Continued)

OTHER PUBLICATIONS

Canadian Office Action dated Mar. 27, 2024 for Canadian Application No. 3113904.

(Continued)

*Primary Examiner* — Robert J Popovics
(74) *Attorney, Agent, or Firm* — Husch Blackwell LLP

(57) ABSTRACT

A roof drain including a base defining a channel and an axis, a gravel guard coupled to the base and including a plurality of teeth, where the gravel guard defines a plurality of gullets between the teeth, and a dome coupled to the base, where the dome includes a plurality of ribs, where the ribs define a plurality of gaps therebetween, and where each gap is radially aligned with a corresponding gullet.

10 Claims, 34 Drawing Sheets

(56) References Cited

U.S. PATENT DOCUMENTS 581,893 A 5/1897 Tucker
641,667 A 1/1900 Beeston
644,277 A 2/1900 Clark
810,879 A 1/1906 Perry
853,598 A 5/1907 Rile
902,104 A 10/1908 Neireiter
902,289 A 10/1908 Gribben et al.
1,099,069 A 6/1914 Matthews et al.
1,138,700 A * 5/1915 Sutro ..... G01F 1/52 405/87
1,150,231 A 8/1915 Smith
1,180,018 A 4/1916 Degnan
1,195,827 A 8/1916 Lxjcke
1,252,548 A 1/1918 Carlson
1,252,573 A 1/1918 Holt
1,266,948 A 5/1918 Holt
1,342,918 A 6/1920 Legg
1,348,945 A 8/1920 Hirshstein
1,380,793 A 6/1921 Goldman
1,434,254 A 10/1922 Sanders
1,487,161 A 3/1924 Holt
1,494,234 A 5/1924 Gossett
1,494,882 A 5/1924 Barger
1,503,421 A 7/1924 Innes
1,509,305 A 9/1924 Mahon
1,521,883 A 1/1925 Hess
1,538,924 A 5/1925 Boosey
1,544,761 A 7/1925 Kiefer
1,573,067 A 2/1926 Holland
1,582,646 A 4/1926 Flesch et al.
1,593,550 A 7/1926 Holt
1,596,893 A * 8/1926 Schifter ..... E03C 1/262 4/292
1,601,498 A 9/1926 Hirshstein
1,618,679 A 2/1927 Schifter
1,647,414 A 11/1927 Moore
1,651,321 A 11/1927 Burkelman
1,674,347 A 6/1928 Silverman
1,690,630 A 11/1928 Fleming
1,710,304 A 4/1929 Flynn et al.
1,721,472 A 7/1929 Rose
1,746,683 A 2/1930 Schifter
1,753,262 A 4/1930 Cromwell
1,761,257 A 6/1930 Fleming
1,762,838 A 6/1930 Shand
1,779,936 A 10/1930 Hess
1,791,512 A 2/1931 Schurman
1,809,549 A 6/1931 Duncan et al.
1,838,092 A 12/1931 Cromwell
1,862,134 A 6/1932 Boosey
1,903,366 A 4/1933 Mercier et al.
1,908,933 A * 5/1933 Tinello ..... B01D 35/04 210/489
1,918,509 A 7/1933 Wilcox
1,937,732 A 12/1933 Tverdak
1,963,300 A 6/1934 Fleming
1,973,321 A 9/1934 Schultz
1,988,669 A 1/1935 Sommerfeld
1,991,772 A 2/1935 Rieger et al.
1,996,279 A 4/1935 Dillon
1,999,277 A 4/1935 Boosey
2,019,779 A * 11/1935 Fleming ..... E04D 13/0409 210/164
D101,978 S 11/1936 Williams
2,079,269 A 5/1937 Williams
2,091,927 A 8/1937 Hirshstein
2,094,434 A 9/1937 Sherriff
2,119,923 A 6/1938 Mcintyre
2,121,220 A 6/1938 Filkins
2,121,613 A 6/1938 Schultz
2,131,240 A 9/1938 Tucker
2,142,343 A 1/1939 Wn
2,169,896 A 8/1939 Gazey
2,256,626 A 9/1941 Rile
2,275,628 A 3/1942 Hirshstein
2,283,160 A 5/1942 Boosey
2,283,365 A 5/1942 Heinkel
2,284,416 A 5/1942 Gordon
2,311,654 A 2/1943 Filkins
2,377,373 A 6/1945 Robertson
2,485,547 A 10/1949 Blau
2,490,075 A 12/1949 Matheis
2,517,195 A 8/1950 Gaspar
2,572,208 A 10/1951 Sievert
2,599,205 A 6/1952 Schmid
2,618,356 A 11/1952 Matheis
2,666,493 A 1/1954 Gordon
2,672,983 A 3/1954 Blau
2,689,017 A 9/1954 Schmid
2,699,555 A 1/1955 Green
2,701,644 A 2/1955 Griffiths
2,711,127 A 6/1955 O'Day
2,740,490 A 4/1956 Matheis
2,762,448 A 9/1956 Schmid et al.
2,765,865 A 10/1956 Schmid
2,807,368 A 9/1957 Blau
2,837,212 A 6/1958 Schmid
2,881,921 A 4/1959 Baker et al.
2,885,689 A 5/1959 Morris
2,888,138 A 5/1959 Baker et al.
2,898,129 A 8/1959 Sisk
2,901,927 A 9/1959 Morgan
2,970,697 A 2/1961 Larson et al.
2,976,796 A 3/1961 Anthony et al.
2,994,433 A 8/1961 Sandin
3,095,219 A 6/1963 Tutty
3,121,682 A 2/1964 Alberico
3,212,416 A 10/1965 Boersma
3,245,540 A 4/1966 Johnson
3,321,080 A 5/1967 Pansini et al.
3,357,561 A 12/1967 Schmid et al.
3,378,858 A 4/1968 Candido
3,392,844 A 7/1968 Decarie
3,447,329 A 6/1969 Emberson
3,469,698 A 9/1969 Blendermann
3,469,699 A 9/1969 Blendermann et al.
3,481,632 A 12/1969 Suess
3,517,813 A 6/1970 Thaler
3,529,723 A 9/1970 Hagedorn
D222,354 S * 10/1971 Foltz ..... D23/261
3,667,611 A 6/1972 Pansini
3,722,532 A 3/1973 Ebeling et al.
3,757,812 A 9/1973 Duncan
3,774,765 A 11/1973 Kane et al.
3,811,644 A 5/1974 Arnault
3,884,809 A 5/1975 Logsdon
3,893,919 A 7/1975 Flegel et al.
3,894,302 A 7/1975 Lasater
3,909,412 A 9/1975 Patry
3,932,281 A 1/1976 Pansini
3,935,878 A 2/1976 Ostevik
3,943,100 A 3/1976 Berenbaum et al.
D244,170 S 5/1977 Pearce
4,035,297 A 7/1977 Aldridge et al.
4,073,018 A 2/1978 Arrowood
4,107,929 A 8/1978 Ebeling et al.
4,112,691 A 9/1978 Ebeling et al.
D249,955 S 10/1978 Vogelsang
4,134,162 A 1/1979 Sharland et al.
4,146,939 A 4/1979 Izzi
4,170,047 A 10/1979 Corsette et al.
D255,596 S 6/1980 Johnson
4,216,790 A 8/1980 Stoltz
D256,948 S 9/1980 Boersma
4,230,346 A 10/1980 Goebel
4,246,664 A 1/1981 Reynolds
4,285,812 A 8/1981 Stoltz
4,400,272 A 8/1983 Logsdon
4,437,687 A 3/1984 Wilson
4,460,462 A 7/1984 Arneson
4,471,497 A 9/1984 Riutort et al.
4,487,690 A 12/1984 Logsdon
4,505,499 A 3/1985 Uglow et al.
4,505,814 A 3/1985 Marshall

(56) References Cited

U.S. PATENT DOCUMENTS 4,525,273 A 6/1985 Logsdon
4,652,365 A 3/1987 Ebeling
4,658,449 A 4/1987 Martin
4,683,685 A 8/1987 Ebeling et al.
4,759,163 A 7/1988 Robertson
4,799,713 A 1/1989 Uglow
4,839,927 A 6/1989 Watanabe
4,910,811 A 3/1990 Izzi, Sr.
4,943,100 A 7/1990 Emberson
4,961,848 A 10/1990 Logsdon
D313,101 S 12/1990 Bartholomew et al.
4,984,308 A 1/1991 Handal
4,984,309 A 1/1991 Lowry
5,141,633 A * 8/1992 Walczak ..... E04D 13/0409 210/232
5,174,128 A 12/1992 Bourne et al.
5,179,969 A * 1/1993 Peterson ..... F04F 5/46 137/142
5,234,582 A 8/1993 Savoie
D341,413 S * 11/1993 Nichols ..... D23/261
D343,228 S * 1/1994 Colin ..... D23/261
5,372,715 A 12/1994 Maggard et al.
5,378,356 A 1/1995 Logsdon
5,394,657 A 3/1995 Peterson
5,409,602 A * 4/1995 Sorenson ..... E04D 13/0767 52/12
5,449,459 A * 9/1995 Glaser ..... B01D 35/02 425/197
5,458,769 A 10/1995 Johannessen
5,469,670 A 11/1995 Thaler
5,522,197 A 6/1996 Ebeling
5,526,613 A 6/1996 Simeone, Jr.
5,531,543 A 7/1996 Johnsen
5,575,903 A 11/1996 Kato
5,615,526 A 4/1997 Palmer et al.
5,618,416 A 4/1997 Haefner
5,650,065 A 7/1997 Sewell
D385,956 S 11/1997 Doughty et al.
5,689,928 A 11/1997 Rasksen
5,702,596 A 12/1997 Juple et al.
5,722,791 A 3/1998 Dallmer
5,724,684 A 3/1998 Paar
5,724,777 A 3/1998 Hubbard
5,733,444 A 3/1998 Johnson
5,734,999 A 4/1998 Nicholas
5,735,091 A 4/1998 Hawkins et al.
5,744,048 A * 4/1998 Stetler ..... E03F 5/0401 210/232
5,749,190 A 5/1998 Williams
5,799,339 A 9/1998 Perry et al.
5,800,092 A 9/1998 Nill et al.
5,843,306 A 12/1998 Singleton
5,902,008 A 5/1999 Butsuen et al.
5,926,865 A 7/1999 Witinski et al.
5,966,884 A 10/1999 Uglow
6,004,457 A 12/1999 Singleton
6,041,556 A 3/2000 Keller
6,056,014 A 5/2000 Kojima et al.
6,141,916 A 11/2000 Shackelford
6,163,896 A 12/2000 Lee
6,165,357 A 12/2000 Cormier
6,168,208 B1 1/2001 Thaler
D439,957 S 4/2001 Barnett et al.
6,209,572 B1 4/2001 Wicklund
6,209,586 B1 4/2001 Wright
6,261,445 B1 7/2001 Singleton
D446,844 S 8/2001 Claussen et al.
6,295,661 B1 10/2001 Bromley
6,318,397 B1 11/2001 Huber et al.
6,340,035 B2 1/2002 Wright
6,360,379 B1 3/2002 Lane et al.
6,360,779 B1 3/2002 Wagner et al.
6,393,631 B2 5/2002 Schroader
6,397,408 B1 6/2002 Veloskey et al.
6,408,452 B1 6/2002 Bromley
D460,810 S 7/2002 Sommerhein
6,428,693 B2 8/2002 Singleton
6,442,774 B2 * 9/2002 Wilson ..... E04H 4/1236 4/292
6,453,482 B1 * 9/2002 Mullings ..... E04H 4/1236 4/286
D466,198 S 11/2002 Mullings
6,588,029 B2 7/2003 Mullings
6,594,966 B2 7/2003 Froeter
6,609,257 B1 8/2003 O'Geary
6,615,417 B1 9/2003 Newhard
6,631,588 B1 10/2003 Distler
6,647,682 B2 11/2003 Bishop
6,687,925 B2 2/2004 Minnick
6,810,537 B1 11/2004 Barnes et al.
6,833,067 B2 12/2004 Dresmann
6,953,208 B2 10/2005 Warnecke
7,005,061 B1 2/2006 Downs et al.
7,010,889 B1 3/2006 Renfro
7,011,746 B2 3/2006 Bckmann
7,108,783 B2 9/2006 Glazik
7,178,179 B2 2/2007 Barnes
D550,819 S 9/2007 Seehoff
7,300,573 B1 11/2007 Trangsrud
D563,529 S 3/2008 Labonte
7,346,938 B2 * 3/2008 Mattson, Jr. ..... A61H 33/6073 4/490
7,407,574 B2 8/2008 Robinson
7,415,802 B2 8/2008 Froeter et al.
D576,257 S 9/2008 Rattenbury
D578,619 S 10/2008 Rattenbury
D598,523 S * 8/2009 McAlpine ..... D23/268
D598,987 S 8/2009 Mcalpine
7,591,111 B2 9/2009 Froeter et al.
7,614,198 B1 11/2009 Piskula et al.
D606,174 S * 12/2009 Martin ..... D23/261
7,658,043 B2 2/2010 Wroblewski
D613,829 S 4/2010 Griffin et al.
7,718,055 B2 5/2010 Iou
7,739,757 B2 6/2010 Witt
D621,009 S 8/2010 Mjelde et al.
7,784,242 B2 8/2010 Warnecke
D629,875 S 12/2010 Sears
7,854,838 B2 12/2010 Martin
7,875,178 B2 * 1/2011 Ashliman ..... B01D 24/007 210/477
D636,059 S 4/2011 Shorey et al.
7,946,087 B1 5/2011 Seitzinger
7,997,038 B2 8/2011 Warnecke et al.
8,006,449 B2 8/2011 Warnecke
D649,625 S 11/2011 Dewitt et al.
D655,795 S 3/2012 Dewitt et al.
8,146,308 B2 4/2012 Warnecke et al.
8,246,430 B1 8/2012 Paynton et al.
8,272,078 B2 * 9/2012 Snow ..... E04H 4/1218 4/507
8,277,646 B2 * 10/2012 Singleton ..... C02F 1/006 210/163
D670,363 S 11/2012 Yousufzai
8,347,424 B2 1/2013 Wroblewski et al.
8,496,822 B2 7/2013 Schoell et al.
8,557,108 B2 10/2013 Rennels
8,557,109 B1 10/2013 Sutherland
8,578,523 B2 * 11/2013 Eichler ..... E03F 5/0404 4/286
8,595,992 B2 12/2013 May et al.
8,628,657 B1 1/2014 Robillard et al.
8,679,328 B2 3/2014 Hebert
8,834,714 B2 9/2014 Chien
8,850,633 B2 10/2014 Erlebach
8,869,319 B2 10/2014 Griffin et al.
8,881,490 B2 11/2014 Wroblewski et al.
8,950,123 B1 2/2015 Chai et al.
8,951,413 B2 2/2015 Lawson
8,973,325 B1 3/2015 Chai et al.
D726,886 S 4/2015 Sutherland
9,015,870 B2 4/2015 Ball
9,015,876 B2 4/2015 Ball

(56) References Cited

U.S. PATENT DOCUMENTS

D730,498 S 5/2015 Gonzalez
D733,263 S 6/2015 Fujii et al.
9,057,519 B1 6/2015 Paynton et al.
9,103,107 B2 8/2015 Wroblewski
9,139,365 B2 9/2015 Andersen
D743,509 S 11/2015 Traub et al.
D748,760 S 2/2016 Lohmann
D754,305 S 4/2016 Papadatos
9,334,618 B1 5/2016 Dodd
9,340,988 B2 5/2016 Lyristakis
D761,942 S 7/2016 Santos
9,422,709 B2 8/2016 Wroblewski
9,428,900 B2 8/2016 Wroblewski et al.
9,435,435 B2 9/2016 Gavin
9,453,331 B1 9/2016 Buffington
9,458,616 B2 10/2016 Whiteside
9,518,389 B1 12/2016 Mcdanal
9,518,616 B2 12/2016 Wolf et al.
9,573,086 B2 2/2017 Corder
D781,401 S 3/2017 Yan
9,637,928 B2 5/2017 Liptak et al.
9,643,113 B2 5/2017 Farmer et al.
D790,673 S 6/2017 Santos
D790,674 S 6/2017 Santos
D792,563 S 7/2017 Coronado et al.
9,719,240 B1 8/2017 Montague
D803,992 S 11/2017 Huber
9,822,539 B1 11/2017 Krombein
9,834,920 B2 * 12/2017 Priester ..... E03F 5/041
9,920,533 B2 3/2018 Johnsen
9,945,125 B2 4/2018 Huber
D816,812 S 5/2018 Huber
D832,406 S 10/2018 Huber
10,113,303 B2 10/2018 Mardian et al.
D837,950 S 1/2019 Santos
10,167,622 B2 1/2019 Brooks et al.
D840,516 S 2/2019 Haynes
10,196,806 B2 2/2019 Priester
10,214,345 B1 * 2/2019 Howie ..... B65D 90/105
10,294,651 B2 * 5/2019 Dannrup ..... B01D 35/143
D851,223 S 6/2019 Krombein
D856,498 S 8/2019 Bayyouk et al.
D857,860 S 8/2019 Coronado et al.
10,428,529 B1 10/2019 Tanghongs
10,465,370 B2 11/2019 Donnelly
10,487,492 B2 11/2019 Boersma
10,519,666 B2 12/2019 Huber
D881,338 S 4/2020 Chen
10,676,930 B2 6/2020 West
10,711,447 B2 7/2020 Say et al.
10,711,463 B2 7/2020 Huber
10,760,275 B2 9/2020 Leslie
10,822,785 B1 11/2020 Berry
10,907,356 B2 2/2021 Mechler et al.
D911,861 S 3/2021 Gadonniex et al.
10,961,714 B2 3/2021 Herrero-Smith et al.
11,008,748 B1 5/2021 Hodge, Jr.
11,043,103 B1 * 6/2021 Chakraborty ..... H04Q 9/02
11,047,126 B1 6/2021 Whiteside
11,060,292 B2 7/2021 Leslie
D933,171 S * 10/2021 Chen ..... D23/261
11,203,861 B1 12/2021 Bregman
11,286,670 B2 3/2022 Huber
11,293,171 B2 4/2022 Berry
11,346,095 B2 * 5/2022 Say ..... E03F 5/06
11,441,305 B1 9/2022 Alhazza
11,447,943 B2 9/2022 Donnelly
D983,939 S * 4/2023 Mayberry ..... E03C 1/264 D23/261
11,634,910 B2 4/2023 Leslie
11,643,819 B2 5/2023 Huber
11,708,690 B2 7/2023 Singleton
11,834,820 B2 * 12/2023 Diao ..... E03F 5/06
D1,010,071 S 1/2024 Turk
11,920,350 B2 3/2024 Iftissen
11,952,780 B2 * 4/2024 Iftissen ..... E04D 13/0409
11,980,835 B2 * 5/2024 Zarraonandia ..... B01D 29/33
12,012,760 B2 * 6/2024 Rasmussen ..... E04D 13/0409
12,018,489 B2 6/2024 Majocka et al.
D1,034,919 S 7/2024 Burak
D1,038,886 S 8/2024 Li
D1,043,923 S 9/2024 Howenstein
12,179,238 B2 * 12/2024 Sturgill ..... B08B 13/00
12,180,711 B2 * 12/2024 Williams, II ..... E04D 13/0409
D1,066,607 S * 3/2025 Minter ..... D23/261
12,252,876 B1 * 3/2025 Cai ..... E03F 5/0408
2001/0023842 A1 9/2001 Singleton
2001/0042266 A1 11/2001 Schroader
2002/0100224 A1 8/2002 Martin
2002/0138942 A1 10/2002 Sato et al.
2002/0148039 A1 10/2002 Minnick
2003/0000037 A1 1/2003 Carr et al.
2003/0037498 A1 2/2003 Bishop
2003/0084631 A1 5/2003 Froeter
2003/0141231 A1 7/2003 Rattenbury et al.
2003/0159384 A1 8/2003 Warnecke
2003/0201217 A1 10/2003 Dresmann
2004/0182763 A1 9/2004 Bockmann
2005/0166315 A1 8/2005 Warnecke et al.
2005/0178073 A1 8/2005 Froeter et al.
2005/0203468 A1 9/2005 Warnecke
2006/0011599 A1 1/2006 Graves
2006/0053544 A1 3/2006 Hui
2006/0059813 A1 3/2006 Froeter et al.
2006/0090257 A1 5/2006 Geller
2006/0124519 A1 6/2006 Glazik
2006/0242913 A1 11/2006 Zhou
2006/0278573 A1 * 12/2006 Robinson ..... E04D 13/0767 52/12
2007/0137126 A1 6/2007 Sommerhein
2007/0205144 A1 9/2007 Robinson
2007/0245485 A1 10/2007 Mcmullen
2007/0262030 A1 11/2007 Meng Fei et al.
2008/0022455 A1 1/2008 Mcalpine
2008/0028515 A1 2/2008 Miller
2008/0222800 A1 9/2008 Warnecke
2008/0245421 A1 10/2008 Iou
2009/0007343 A1 * 1/2009 Houck ..... E03C 1/264 7/167
2009/0013620 A1 1/2009 West
2009/0049594 A1 2/2009 Landsberger et al.
2009/0065071 A1 3/2009 Vahlbrauk
2009/0302545 A1 12/2009 Haynes
2010/0025312 A1 2/2010 Martin
2010/0213140 A1 8/2010 Won
2010/0257791 A1 10/2010 May et al.
2011/0003117 A1 1/2011 Piumarta
2011/0023229 A1 2/2011 Warnecke et al.
2011/0030284 A1 2/2011 May et al.
2011/0031174 A1 * 2/2011 Liang ..... E03F 5/0407 210/166
2011/0049036 A1 3/2011 Schoell et al.
2011/0209279 A1 9/2011 Ball
2011/0314748 A1 12/2011 Smith
2012/0025517 A1 2/2012 Majocka et al.
2012/0062384 A1 * 3/2012 McDanal ..... G08B 21/20 340/605
2012/0222996 A1 9/2012 Rennels
2013/0264256 A1 10/2013 Hebert
2013/0333304 A1 12/2013 Smith
2014/0069854 A1 3/2014 Sutherland
2014/0158593 A1 6/2014 Chien
2014/0265158 A1 9/2014 Liptak et al.
2015/0000004 A1 1/2015 Silverberg
2015/0047267 A1 * 2/2015 May ..... E04D 13/0409 52/12
2015/0115596 A1 4/2015 Donnelly
2015/0151915 A1 6/2015 Andersen
2015/0233628 A1 8/2015 Farmer et al.
2015/0292662 A1 10/2015 Majocka et al.
2016/0153195 A1 6/2016 Johnsen
2016/0230393 A1 8/2016 Huber
2016/0333586 A1 11/2016 King
2017/0241123 A1 * 8/2017 Dannrup ..... C02F 1/001

(56) References Cited

U.S. PATENT DOCUMENTS

| | | | | |
|---|---|---|---|---|
| 2017/0247886 | A1 | 8/2017 | West | |
| 2018/0030713 | A1 | 2/2018 | Howson | |
| 2018/0080484 | A1 | 3/2018 | Venkatesan et al. | |
| 2018/0112407 | A1 | 4/2018 | Herrero-Smith et al. | |
| 2018/0195287 | A1 | 7/2018 | Huber | |
| 2018/0195288 | A1 | 7/2018 | Huber | |
| 2018/0266094 | A1* | 9/2018 | Priester | E03C 1/26 |
| 2018/0266096 | A1* | 9/2018 | Mardian | E03F 5/06 |
| 2019/0000779 | A1 | 1/2019 | Dukes et al. | |
| 2019/0078311 | A1 | 3/2019 | Pivinen | |
| 2019/0100906 | A1 | 4/2019 | Mcleod | |
| 2019/0177962 | A1* | 6/2019 | Montague | E03F 5/0404 |
| 2019/0383019 | A1 | 12/2019 | Hetzler et al. | |
| 2019/0383020 | A1 | 12/2019 | Mechler et al. | |
| 2020/0080291 | A1* | 3/2020 | Hsu | E03C 1/264 |
| 2020/0181913 | A1 | 6/2020 | Leslie | |
| 2020/0284037 | A1 | 9/2020 | Leslie | |
| 2020/0340230 | A1 | 10/2020 | Say et al. | |
| 2020/0378126 | A1 | 12/2020 | Huber | |
| 2021/0047817 | A1 | 2/2021 | Berry | |
| 2021/0131088 | A1 | 5/2021 | Say et al. | |
| 2021/0180306 | A1* | 6/2021 | Singleton | E03F 5/06 |
| 2021/0238839 | A1 | 8/2021 | Say et al. | |
| 2021/0317666 | A1 | 10/2021 | Majocka et al. | |
| 2021/0348390 | A1 | 11/2021 | Iftissen | |
| 2021/0363744 | A1 | 11/2021 | Deering | |
| 2021/0396015 | A1 | 12/2021 | Leslie | |
| 2021/0404168 | A1* | 12/2021 | Singleton | E03F 5/14 |
| 2022/0025653 | A1 | 1/2022 | Huber | |
| 2022/0120086 | A1 | 4/2022 | Majocka et al. | |
| 2022/0145635 | A1 | 5/2022 | Rasmussen et al. | |
| 2022/0316213 | A1 | 10/2022 | Huber | |
| 2022/0316214 | A1 | 10/2022 | Williams, II | |
| 2022/0316215 | A1 | 10/2022 | Iftissen | |
| 2023/0108534 | A1 | 4/2023 | Majocka et al. | |
| 2023/0128617 | A1* | 4/2023 | Hanayama | H04R 1/24 381/182 |
| 2023/0139368 | A1 | 5/2023 | Henderson | |
| 2023/0228087 | A1 | 7/2023 | Majocka et al. | |
| 2023/0257996 | A1 | 8/2023 | Leslie | |
| 2023/0272620 | A1 | 8/2023 | Rasmussen et al. | |
| 2024/0003134 | A1* | 1/2024 | Huber | E04D 13/0409 |
| 2024/0058844 | A1 | 2/2024 | Sturgill | |
| 2024/0159037 | A1 | 5/2024 | Macdonald | |
| 2024/0271407 | A1* | 8/2024 | Singleton | E03F 5/14 |
| 2024/0301697 | A1* | 9/2024 | Majocka | E04D 13/0409 |
| 2024/0337106 | A1* | 10/2024 | Rasmussen | G08B 25/10 |
| 2024/0344317 | A1* | 10/2024 | Eisen | E03F 5/06 |
| 2024/0410155 | A1* | 12/2024 | Huber | E03F 5/06 |
| 2025/0041904 | A1* | 2/2025 | Sturgill | A46B 13/02 |

FOREIGN PATENT DOCUMENTS

| | | | |
|---|---|---|---|
| CH | 360192 | A | 2/1962 |
| DE | 1268557 | B | 5/1968 |
| DE | 1658226 | B1 | 1/1970 |
| FR | 1226049 | A | 7/1960 |
| GB | 2347451 | A | 9/2000 |
| WO | 2017182711 | A1 | 10/2017 |

OTHER PUBLICATIONS

Zurn 100DP Froet Drain Specification Sheet, 1 page, Jan. 20, 2019. (Year: 2019).

Zurn, "Specific Drainage," SD0119 Customer Guide © 2019 (12 pages).

Manual SK-2 Specifications and Roughing Dimensions, Josam Plumbing Drainage Product, Josam Manufacturing Co., U.S., 1959, 4 pages (cover pages and p. 99).

Josam Plumbing Drainage Guide—Five, Josam Manufacturing Co., U.S., Mar. 28, 1975, 4 pages (cover pages and p. 86).

Josam Plumbing Drainage Guide—Six, Josam Manufacturing Co., U.S., Oct. 15, 1980, 3 pages (cover pages and p. 73).

Josam Plumbing Drainage Guide—Seven, Josam Manufacturing Co., U.S., Jun. 1, 1984, 4 pages (cover pages and p. 77).

Olympic Manufacturing Group (OMG, Inc.), Internet; Olyfast Accessories, Olyflow Drain Systems, FlowControl, OverFlow, and QuickFlow, website: http://www.olyfastcom, viewed Feb. 28, 2005; (2 Pages).

Jay R. Smith MFG_ Co., "Roof Drain Technical Data Sheet," Manual 2008 (19 pages).

RJ Smith Catalogue 2008 18 pages (Year: 2008).

Froet Drain 12 pages Jan. 1, 2019 (Year: 2019).

Wade-Roof-Drain-ID-Selection-Guide; pp. 219-278; Wade Drains, Dated Jan. 1, 2019. (Year: 2019).

Zurn 100C Froet Drain Specification Sheet, 1 page, Nov. 18, 2021. (Year: 2021).

Zurn FloForce Improper Roof Membrane Installation, 1 page, May 5, 2022. (Year: 2022).

Zurn Z100 FloForce Roof Drain General Installation Instructions, 1 page, May 5, 2022 (Year: 2022).

Zurn Z100 FloForce Specification Sheets, 6 pages, Aug. 8, 2023. (Year: 2023).

Zurn Z100 FloForce Design Guide, 9 pages, Undated, Downloaded: Mar. 5, 2024. (Year: 2024).

* cited by examiner

Drain Outlet Size - 2"

| Flow Data | |
|---|---|
| Avg. Tank Level (in.) | Avg. Flow Rate (GPM) |
| 1.00 | 85.60 |
| 1.28 | 141.96 |
| 1.46 | 147.43 |
| | |
| | |
| | |

Drain Outlet Size - 3"

| Flow Data | |
|---|---|
| Avg. Tank Level (in.) | Avg. Flow Rate (GPM) |
| 1.00 | 81.33 |
| 2.00 | 320.28 |
| 3.03 | 349.76 |
| 4.00 | 352.40 |
| 5.03 | 356.12 |
| 6.00 | 359.25 |

Drain Outlet Size - 4"

| Flow Data | |
|---|---|
| Avg. Tank Level (in.) | Avg. Flow Rate (GPM) |
| 1.00 | 81.68 |
| 2.01 | 314.14 |
| 3.01 | 580.74 |
| 3.99 | 618.29 |
| 5.00 | 624.89 |
| 6.02 | 630.21 |

Drain Outlet Size - 6"

| Flow Data | |
|---|---|
| Avg. Tank Level (in.) | Avg. Flow Rate (GPM) |
| 1.01 | 102.46 |
| 2.00 | 397.65 |
| 3.00 | 757.11 |
| 4.01 | 1164.82 |
| 5.03 | 1489.41 |
| 6.03 | 1505.44 |

Drain Outlet Size - 8"

| Flow Data | |
|---|---|
| Avg. Tank Level (in.) | Avg. Flow Rate (GPM) |
| 1.00 | 122.23 |
| 2.01 | 440.68 |
| 3.00 | 829.67 |
| 4.00 | 1289.54 |
| 5.02 | 1818.32 |
| 5.90 | 2376.50 |

FIG. 35

DOMED OR RAISED DRAIN INLET STRAINERS

CROSS-REFERENCE TO RELATED APPLICATIONS

The present application is a continuation of U.S. patent application Ser. No. 17/192,688, filed Mar. 4, 2021, which claims priority to U.S. Provisional Patent Application No. 63/009,894, filed Apr. 14, 2020. The entire contents of these applications are hereby incorporated by reference.

FIELD

The embodiments described herein relate to a roof drain, and more particularly, to a roof drain having improved drainage and flow characteristics.

BACKGROUND

Commercial buildings are typically constructed with flat or near flat roofs. Because these building do not have much of a pitch, the collection of water on the roof surface from rain or melting snow can present serious structural loads that could result in collapse. To avoid this possibility, most commercial and industrial building standards require that roofs of this type include drains positioned at locations that ensure the water accumulated thereon can be removed in a timely manner.

SUMMARY

In one embodiment, a roof drain including a base defining a channel and an axis, a gravel guard coupled to the base and including a plurality of teeth, where the gravel guard defines a plurality of gullets between the teeth, and a dome coupled to the base, where the dome includes a plurality of ribs, where the ribs define a plurality of gaps therebetween, and where each gap is radially aligned with a corresponding gullet.

In another embodiment, a roof drain including a base defining an axis, the base having a throat portion and a flange portion extending radially outwardly from the throat portion, where the throat portion at least partially defines a channel therethrough having an outlet, and where the flange portion includes an outer edge and a top plane, a gravel guard coupled to the base and including a plurality of teeth, where the gravel guard defines a plurality of gullets, and where at least a portion of each gullet is positioned axially below the top plane, and a dome coupled to the base.

In another embodiment, a roof drain including a base at least partially defining a channel therethrough, where the channel includes an inlet and an outlet defining an outlet diameter, and where the base defines a top plane, a gravel guard coupled to the base and including a plurality of teeth and a plurality of gullets positioned between adjacent teeth, and a dome coupled to the base, where the roof drain is configured to flow between 75 GPM and 150 GPM through the channel at 1" of head pressure measured relative to the top plane.

BRIEF DESCRIPTION OF THE DRAWINGS

FIGS. 35-36 illustrate flow data generally corresponding to an embodiment of the roof drain.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

Figure 27:
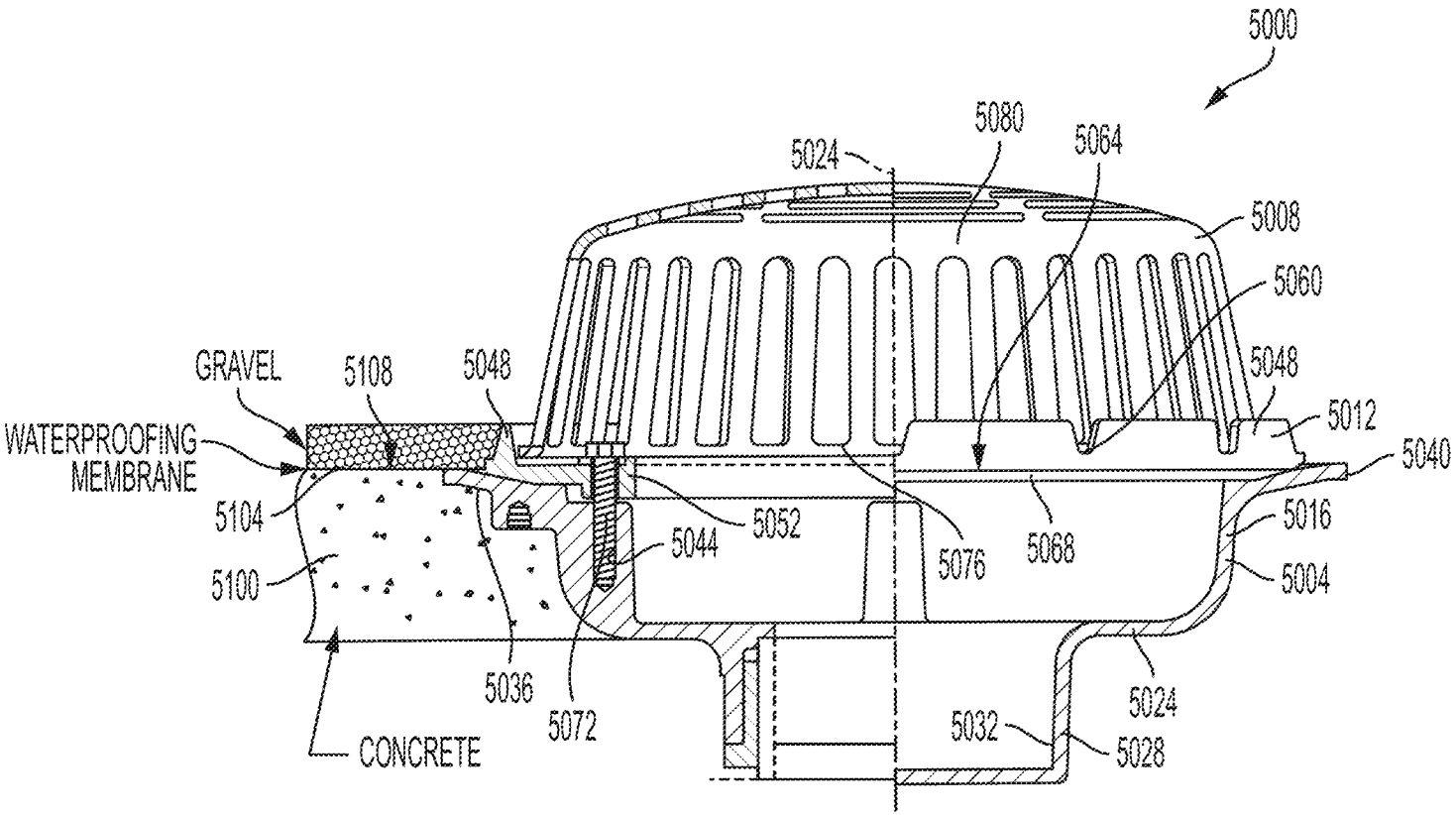
FIG. 27 PRIOR ART
FIG. 27 illustrates a prior art embodiment of a roof drain installed on a roof.

FIG. 27 illustrates a prior art embodiment of a roof drain 5000 mounted to a roof 5100 with a roof membrane 5104 to produce a finished surface 5108. The roof drain 5000 includes a base 5004, a dome 5008, and a gravel guard 5012. As is shown in FIG. 27, the base 5004 is substantially "bowl" shaped having a first or vertically oriented wall 5016 (e.g., parallel to an axis 5024) along the perimeter thereof and a second or horizontally oriented wall 5020 (e.g., perpendicular to the axis 2024) at the downstream end thereof). Together, the first and second walls 2016, 5020 form a substantially "concave" shape. The second wall 5016 also includes an outlet cylinder 5028 extending axially from the second wall 5020 to produce an outlet 5032. The base 5004 also includes a flange 5036 extending radially outwardly from the first wall 5016 to produce an outer end 5040.

The base 5004 also includes a series of threaded apertures 5044 positioned at least partially within the "bowl" and spaced radially inwardly from the teeth 5048 of the gravel guard 5012.

The gravel guard 5012 of the roof drain 5000 rests against the flange portion 2036 of the base 5004 and includes a series of teeth 5048, and a plurality of bolt apertures 5052 spaced radially inwardly from the teeth 5048. The gravel guard 5012 also includes a plurality of gullets 5060 positioned between the teeth 5048 that are positioned vertically above the finished surface 5108 of the adjacent roof 5100 and vertically above the outer edge 5040 of the base 5004. The gullets 5060 are also positioned above the top surface 5064 of the gravel guard body 5068. When assembled, the gravel guard 5012 is secured to the base 5004 with fasteners 5072 extending through the bolt apertures 5052 and threaded into the threaded apertures 5044 of the base 5004.

As shown in FIG. 27, the dome 5008 of the drain 5000 is attached to the base 5004 via the gravel guard 5012 (e.g., it rests on the gravel guard 5012). The dome 5008 has a completely enclosed bottom edge 5076 and a completely enclosed transition area 5080.

FIGS. 1-5 illustrate a roof drain 10 configured to be installed on the roof 14 of a building. The roof drain 10 includes a base 18 at least partially defining a channel 38, a cage or dome 26, and a gravel guard or gravel ring 30. When installed, the channel 38 of the drain 10 is placed in fluid communication with a plumbing system 34 (e.g., a network of conduits to reroute the rainwater off of the roof) of the corresponding building such that water accumulating on the roof 14 is collected by the drain 10 and directed into the plumbing system 34 via the channel 38. More specifically, the roof drain 10 is configured to intake rain water and discharge the water into the plumbing system 34 producing a gravitational flow therein. Generally speaking, a gravitational flow system operates using the force of gravity to generate the flow therein typically through pitched piping and the like. Gravitational flow systems generally permit both air and water to enter the plumbing system 34. A gravitational system is different than a siphonic system which is configured to operate with the piping completely charged with water so that siphonic forces are utilized to encourage the flow of fluids therethrough.

The base 18 of the drain 10 is substantially "funnel" shaped defining the channel 38 through which rainwater may be directed into the plumbing system 34 of the building. More specifically, when rainwater collects on the roof 14, the water flows into the inlet 40 of the channel 38 where it is directed into the plumbing or drain system 34 via the outlet 22 thereof. In the illustrated embodiment, the base 18 includes a throat portion 42 at least partially defining the channel 38, and a flange portion 46 extending radially outwardly from the throat portion 42. Together, the throat portion 42 and flange portion 46 define a central axis 50. While the illustrated base 18 is cast as a single piece of material, it is to be understood that in alternative embodiments, the base 18 may be formed as multiple pieces coupled together.

Figure 7:
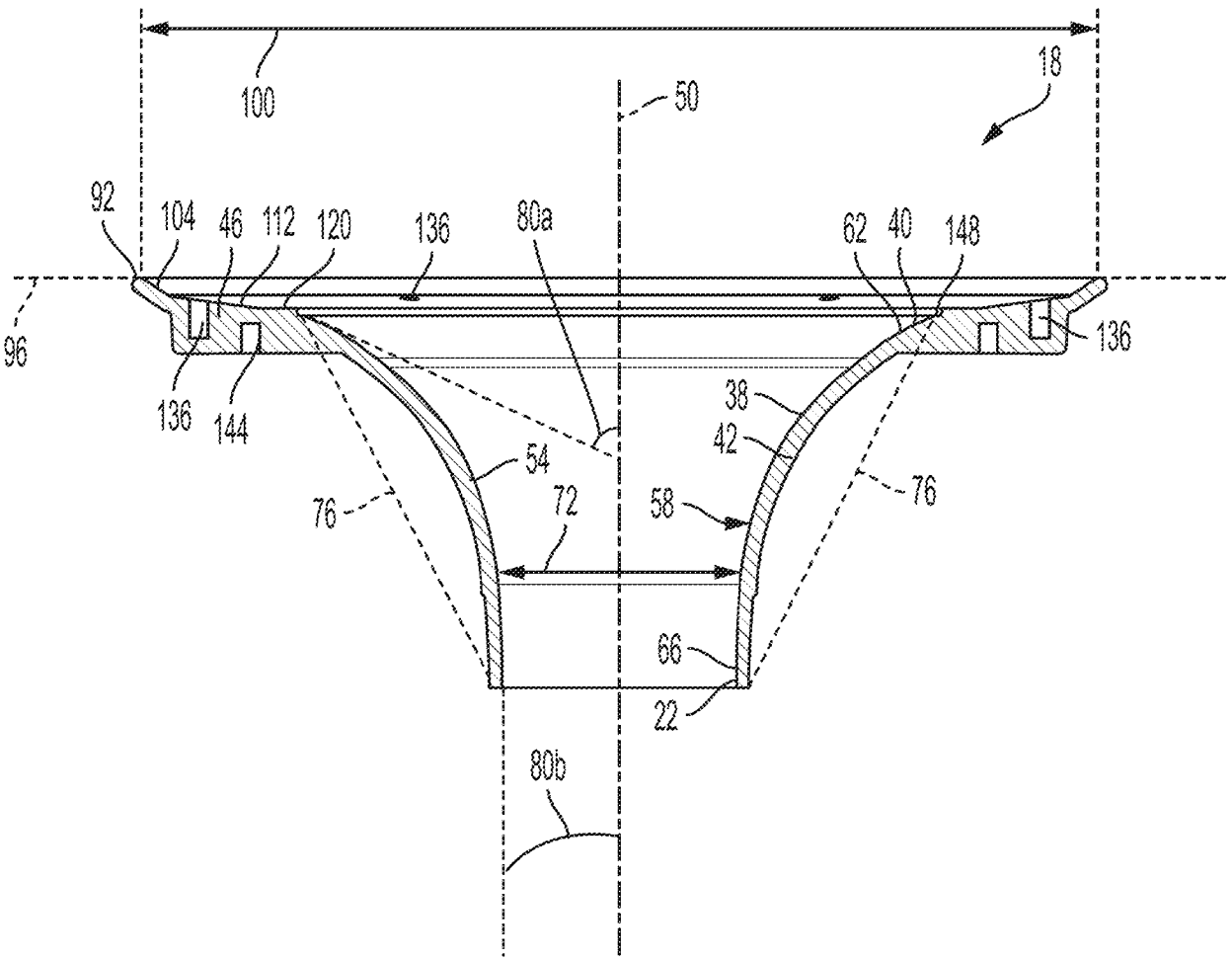
FIG. 7 is a section view taken along line 7-7 of FIG. 6.

The throat portion 42 of the base 18 is formed from a substantially annular wall 54 having an inner surface 58, a first end 62 generally corresponding with the inlet 40 of the channel 38, and a second end 66 opposite the first end 62 that generally corresponds with and forms the outlet 22 of the channel 38. The inner surface 58 is shaped such that the inner diameter 72 of the inner surface 58 continuously and smoothly decreases as it extends axially away from the first end 62 and toward the second end 66. More specifically, the cross-sectional shape of the inner surface 58, taken along the axis 50, forms a substantially convex shape over its entire axial length (see FIG. 7). The throat portion 42 also defines a frusto-conical-datum surface 76 generally defined as a frusto-conically-shaped surface that is co-axial with the axis 50 and extends from the first end 62 to the second end 66. In such embodiments, the inner surface 58 is shaped such that it is always positioned radially inside the frusto-conical datum surface 76.

Figure 4:
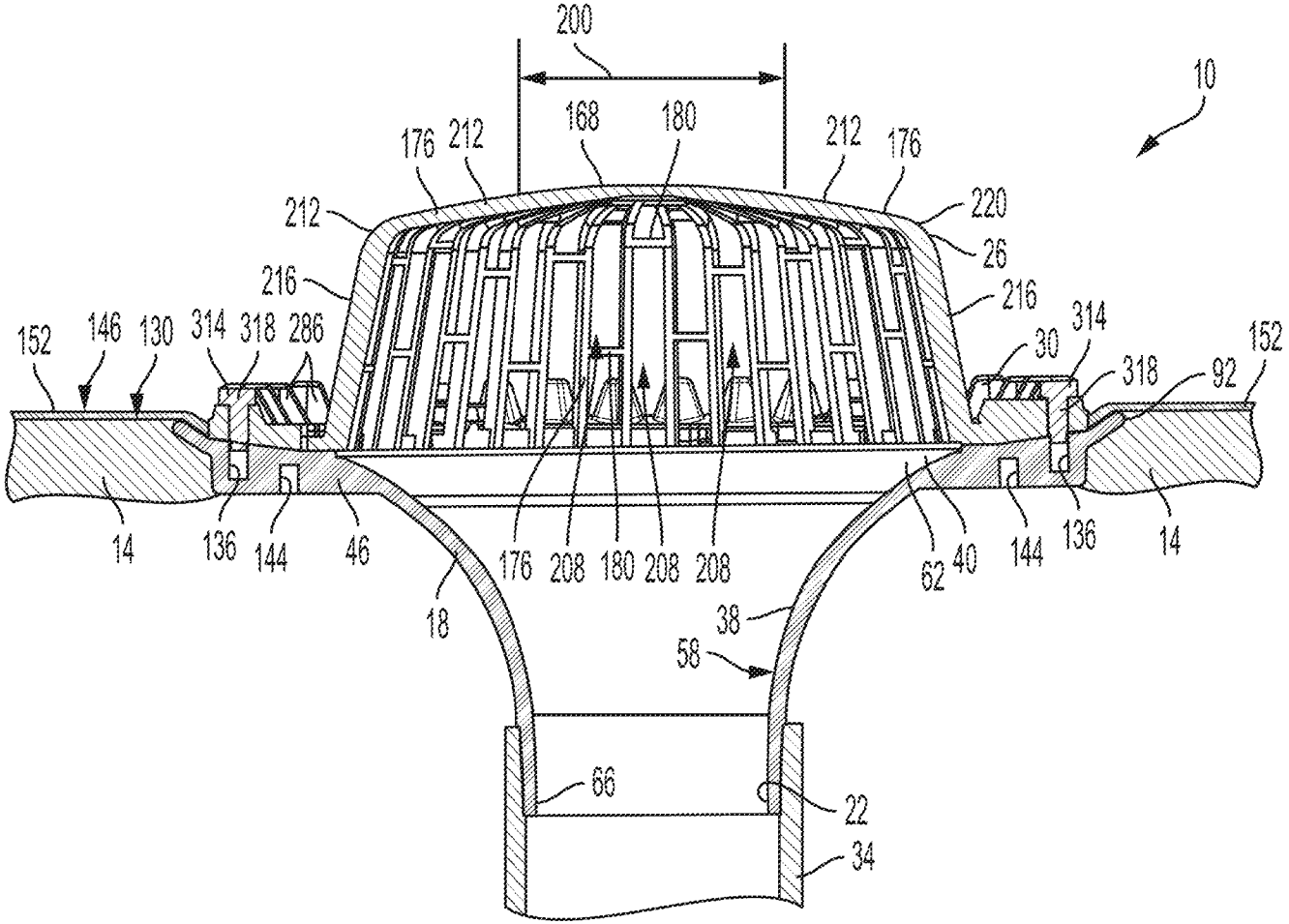
FIG. 4 is a section view taken along line 4-4 of FIG. 3.

The inner surface 58 of the throat portion 42 forms a first surface angle 80*a* relative to the axis 50 at the first end 62 thereof and a second surface angle 80*b* relative to the axis 50 at the second end 66 thereof (see FIG. 4). In the illustrated embodiment, the first surface angle 80*a* is greater than the second surface angle 80*b*. Furthermore, the inner surface 58 smoothly transitions from the first surface angle 80*a* to the second surface angle 80*b* while always decreasing in value. In the illustrated embodiment, the first surface angle 80*a* is between approximately 40 and 70 degrees while the second surface angle 80*b* is between approximately 0 and 15 degrees. In other embodiments, the first angle 80*a* is between approximately 50 and 65 degrees. In still other embodiments, the first angle 80*a* is approximately one of 51 degrees, 52 degrees, 59 degrees, 60 degrees, and 62 degrees. Other embodiments, the second angle 80*b* may be between approximately 0 and 5 degrees. In still other embodiments, the second angle 80*b* may be approximately 3 degrees. In still other embodiments, the first angle 80*a* and second angle 80*b* may vary depending on the diameter of the outlet 22.

Figure 22:
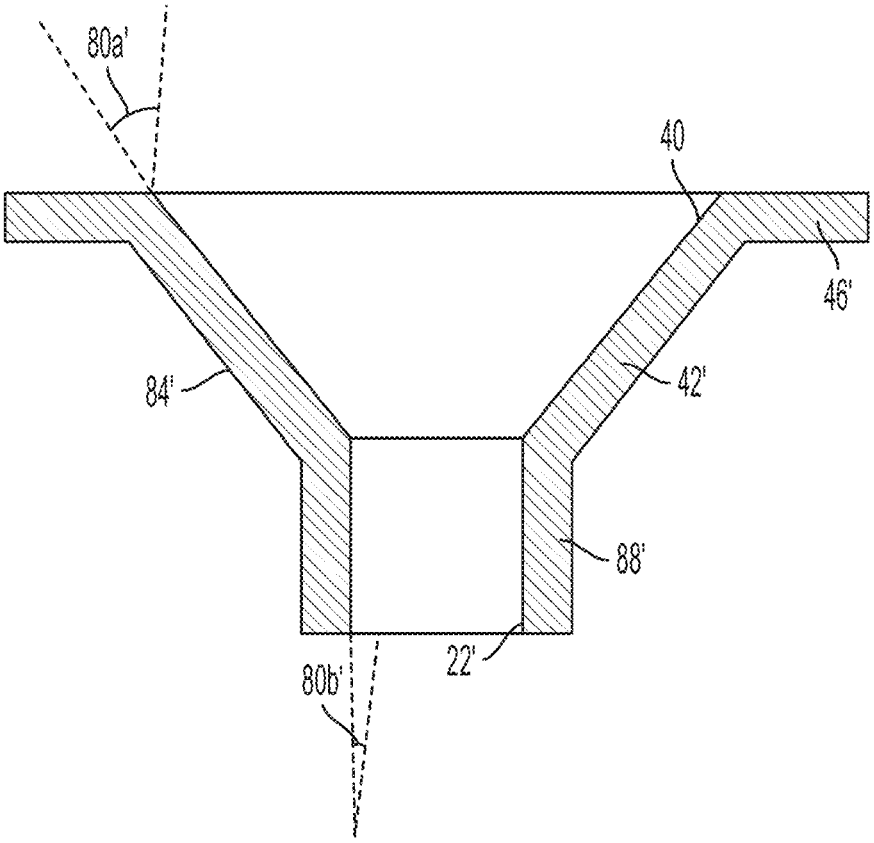
FIG. 22 is a perspective view of another embodiment of a base.

While the illustrated inner surface 58 provides a smooth, curved, convex shape, it is to be understood that alternative shapes may also be used. For example, FIG. 22 illustrates an alternative embodiment of the throat portion 42' having an alternative embodiment of the inner surface 58'. The inner surface 58' includes a frusto-conical portion 84' and a cylindrical portion 88' extending axially from the narrow end of the frusto-conical portion 84'. In such embodiments, the frusto-conical portion 84' includes a first constant surface angle 80*a*' that transitions to a second surface angle 80*b*' at the cylindrical portion 88'. Such an inner surface 58' does not include any concave portions (e.g., instances where the surface angle 80*a*', 80*b*' increases as it extends from the first end 62' to the second end 66').

Figure 8:
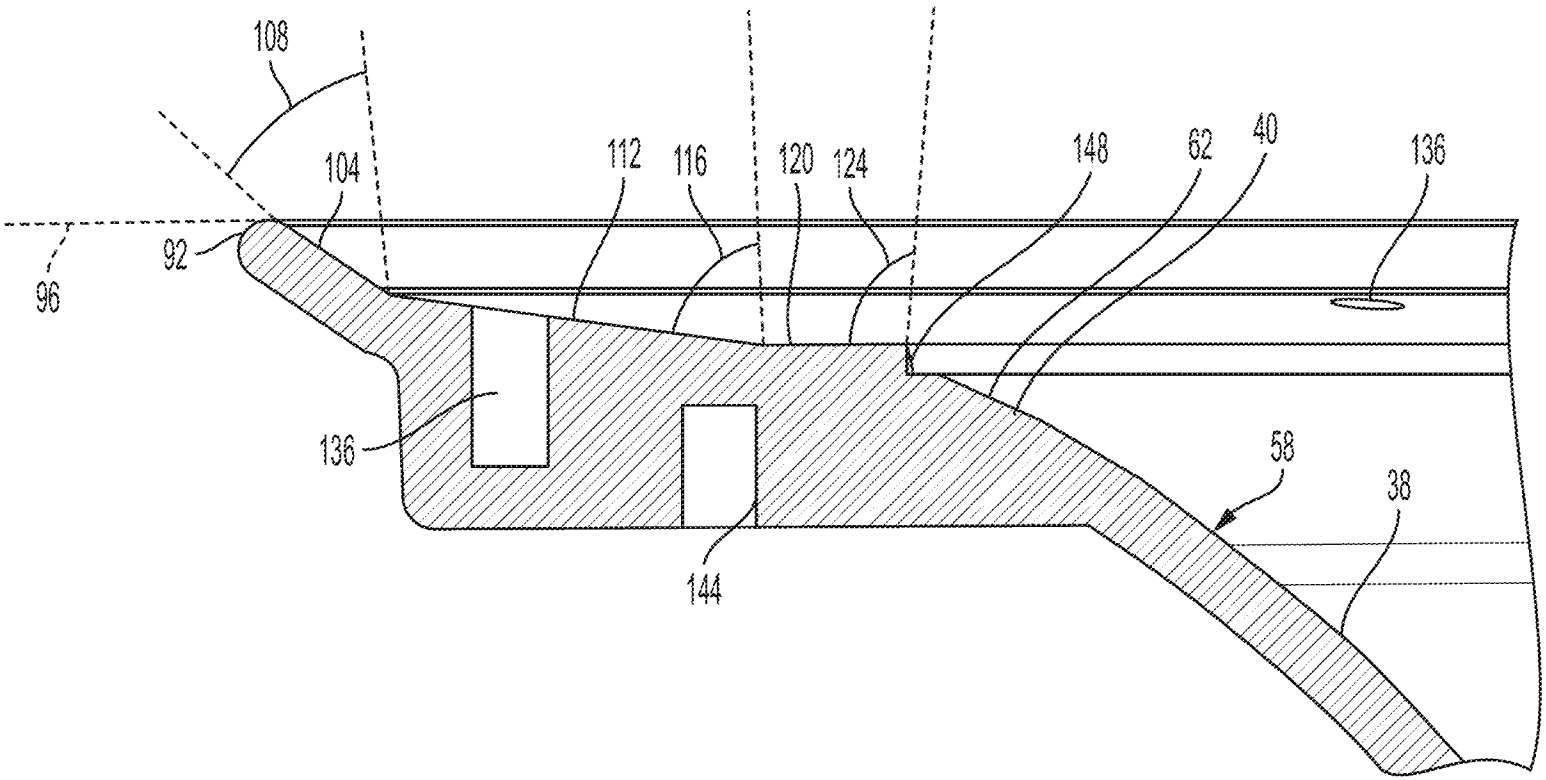
FIG. 8 is a detailed section view taken from FIG. 7.

The flange portion 46 of the base 18 extends radially outwardly from the first end 62 of the throat portion 42 to produce an outer edge 92. The outer edge 92, in turn, defines a top plane 96 (e.g., generally oriented normal to the axis 50 and positioned at the axial highest point of the base 18), and an outer diameter 100. The flange portion 46 includes a first portion 104 extending radially inwardly from the outer edge 92 at a first surface angle 108 relative to the axis 50, a second portion 112 extending radially inwardly from the first portion 104 at a second surface angle 116 relative to the axis 50, and a third portion 120 extending radially inwardly from the second portion 112 at a third surface angle 124. As shown in FIG. 8, the first surface angle 108 is less than the second surface angle 116 (e.g., the first surface angle 108 is steeper than the second surface angle 116), and the second surface angle 116 is less than the third surface angle 124 (e.g. the second surface angle 116 is steeper than the third surface angle 124).

When installed, the top plane 96 of the flange portion 46 is generally positioned so that is aligned with the top surface 130 of the roof 14 positioned immediately adjacent thereto. As such, any roof membrane or paper 152 can transition from the roof 14 to the base 18 without producing any high spots or bumps. For the purposes of this application, the top surface 130 of the roof 14 is generally defined as the surface upon which the roof paper 152 is laid (e.g., the top surface of the concrete) and does not include any gravel positioned thereon. Stated differently, the top surface 130 is substantially aligned with the top plane 96. In alternative embodiments, the roof drain 10 may be mounted to a deck plate or other installation apparatus whereby the top surface 130 may include the upper surface of the deck plate upon which the roof paper 152 is laid proximate the roof drain 10.

When the drain 10 is assembled, the second portion 112 and second surface angle 116 are generally configured to match the angle and radial width of the underside of the gravel ring 30 (described below). Similarly, the third portion 120 and third surface angle 124 are generally set to match with the angle and radial size of the underside of the dome 26. (See FIG. 5). While the second and third portions 112, 120 are shown having different surface angles in the illustrated embodiment, it is understood that in other embodiments, they may be the same.

Figure 5:
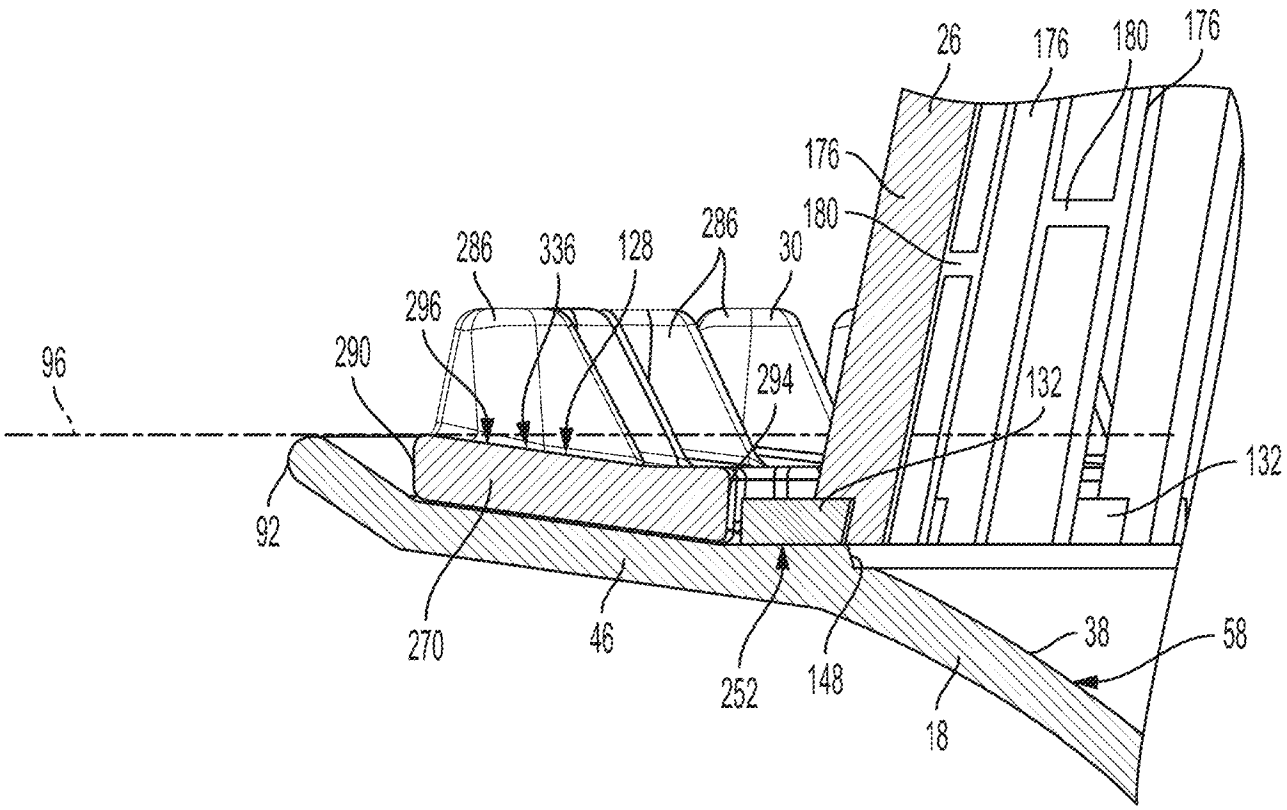
FIG. 5 is a detailed section view taken from FIG. 4.

As shown in FIG. 5, the first portion 104 of the flange portion 46 is sized and shaped such that the outer edge 92 is positioned axially above the remainder of the flange portion 46 when the drain 10 is installed in an upright orientation (e.g., when the axis 50 is substantially vertical in orientation). With the drain 10 assembled, the first portion 104 is sized and shaped such that the outer edge 92 is positioned axially above the low point 126 of at least one gullet 128 of the gravel ring 30 (described below) and the base plates 132 of the dome 26 (described below). In the illustrated embodiment, the outer edge 92 is positioned axially above the low point 126 of each gullet 128 of the gravel ring 30 and above each base plate 132 of the dome 26. Stated differently, the low point 126 of at least one gullet 128 and at least one base plate 132 are positioned axially below the top plane 96. In the illustrated embodiment, the low point 126 of each gullet 128 and each base plate 132 are positioned axially below the top plane 96.

By elevating the outer edge 92 as described above, the drain 10 is configured so that water entering the drain 10 by flowing over the outer edge 92 (e.g., with the outer edge 92 installed level with the roof 14; see FIG. 4) will only encounter flow-paths that are vertically below the point of entry. As such, the water is able to more easily and efficiently flow into the channel 38. This is especially true when the water level on the roof 14 is low. Stated differently, the rainwater from the roof 14 can flow over the outer edge 92, through one or more gullets 128, over and between the dome base plates 132, and into the channel 38 without having to rise higher than the outer edge 92. Stated differently, the drain 10 is configured such that a continuous flow path can be traced from the outer edge 92 to the outlet 22 without rising above the top plane 96.

The base 18 also includes a first plurality of threaded apertures 136 formed into the flange portion 46 and outside the channel 38. During use, the threaded apertures 136 are configured to receive a threaded fastener 140 therein to couple the gravel ring 30 to the base 18. Similarly, the base 18 includes a second plurality of threaded apertures 144 on the underside thereof for securing the base 18 to the roof 14 or other building structure.

Figure 6:
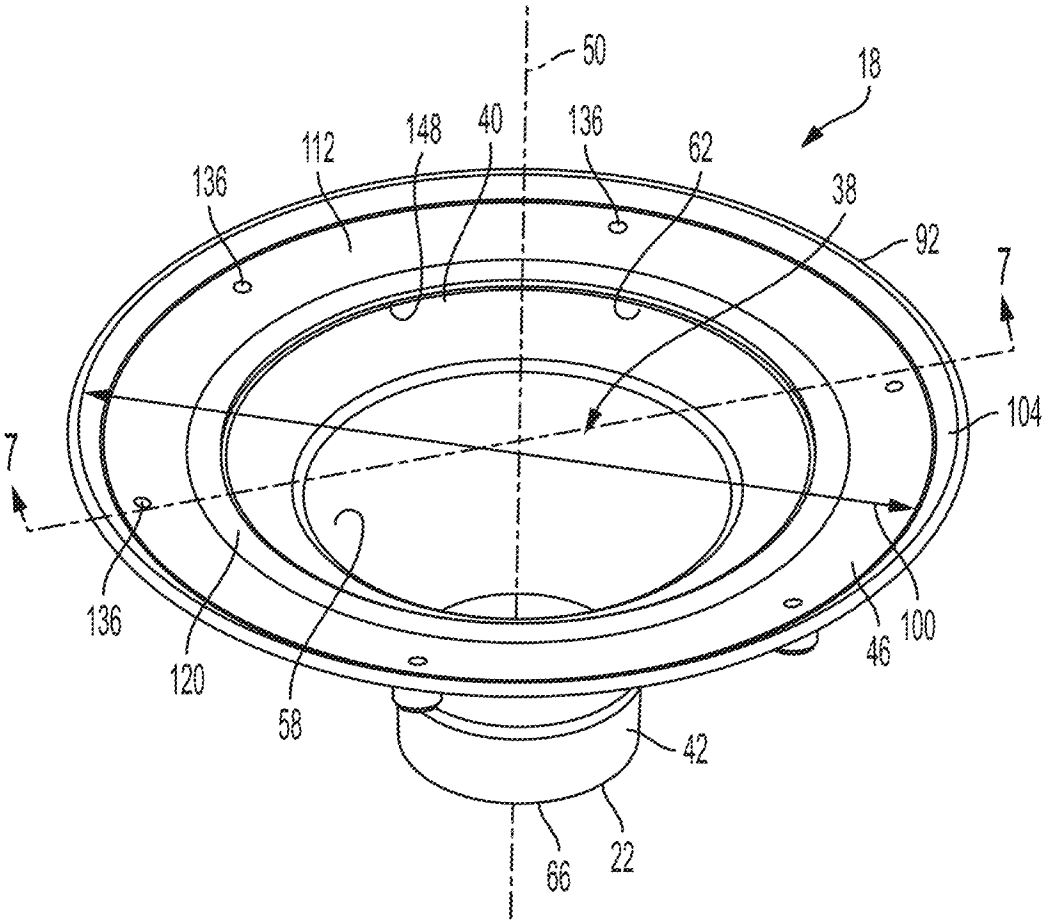
FIG. 6 is a perspective view of a base from the drain of FIG. 1.

The base 18 also includes a cutting groove 148. The cutting groove 148 is formed into the base 18 at a first radial distance from the axis 50. During use, the cutting groove 148 is configured to receive and guide the tip of a knife or razor blade therein so the user can quickly and easily trim the roof paper 152 at the desired location. In the illustrated embodiment, the cutting groove 148 includes a "step" having two adjacent surfaces against which the user's blade may be pressed (e.g., into the corner formed by the two surfaces). However, in alternative embodiments, the groove 148 may be enclosed on three sides (not shown). In still other embodiments, the cutting groove 148 may include other shapes and contours desirable to directing the user during the cutting process. While the illustrated groove 148 is annular in shape, in alternative embodiments, alternative shapes (e.g., polygonal, stepped, and the like) may also be present to produce the desired final cut dimensions. As shown in FIG. 6, the cutting groove 148 of the base 18 is positioned radially inward of the gravel ring 30. The cutting groove 148 is also positioned radially inwardly of the outer diameter 156 of the dome 26 (described below). In some embodiments, the cutting groove 148 may be positioned at a location where the throat portion 42 meets the flange portion 46 at the radially inner barrier of the third portion 120 of the flange portion 46.

As shown in FIG. 4, the outlet 22 of the channel 38 generally defines an outlet diameter 24 generally corresponding to the size of the pipes forming the downspout of the plumbing system. For example, an outlet 22 having a 2" diameter substantially corresponds with a downspout formed from 2" pipe, an outlet having a 3" diameter substantially corresponds with a downspout formed from 3" pipe, and the like. It is understood that the size of the drain 10 may vary proportionally dependent upon the outlet diameter 24 of the outlet 22.

Figure 9:
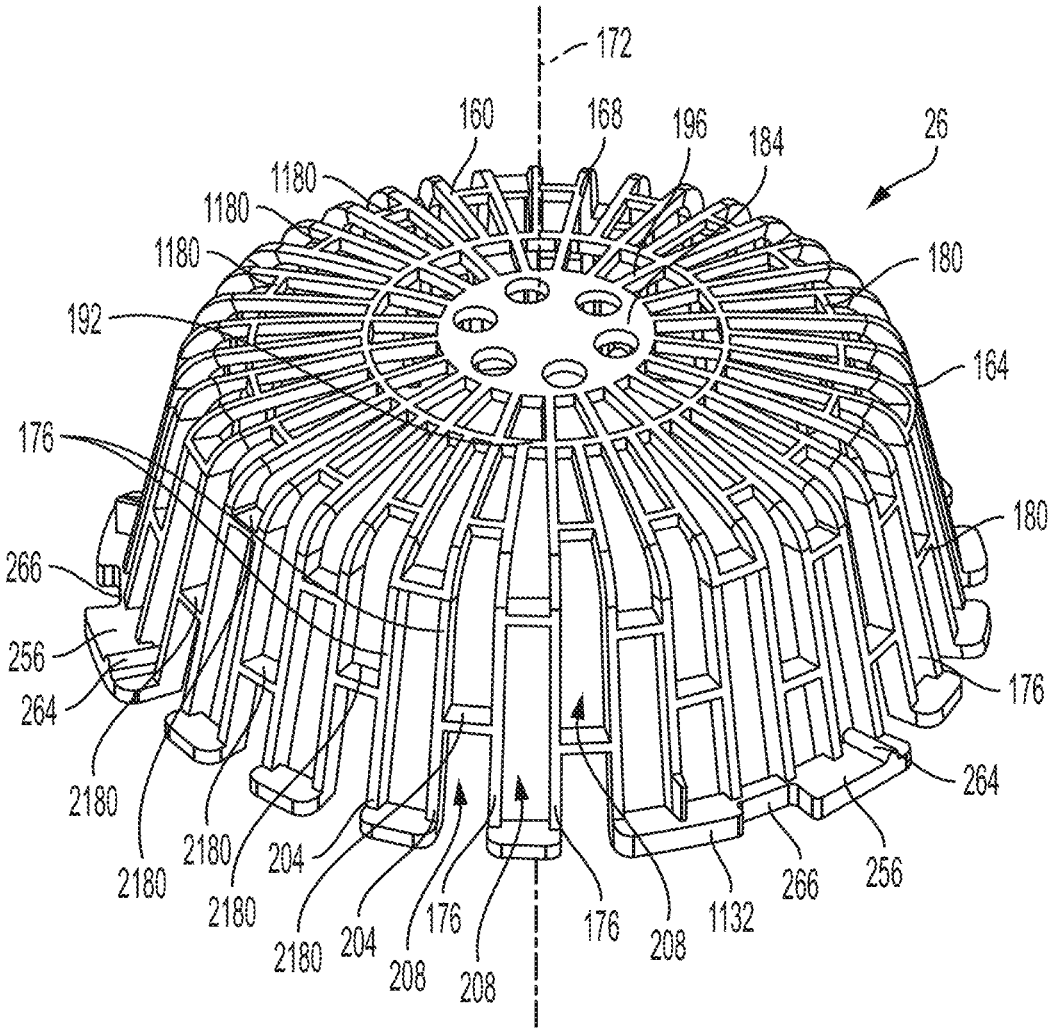
FIG. 9 is a perspective view of a dome from the drain of FIG. 1.
Figure 10:
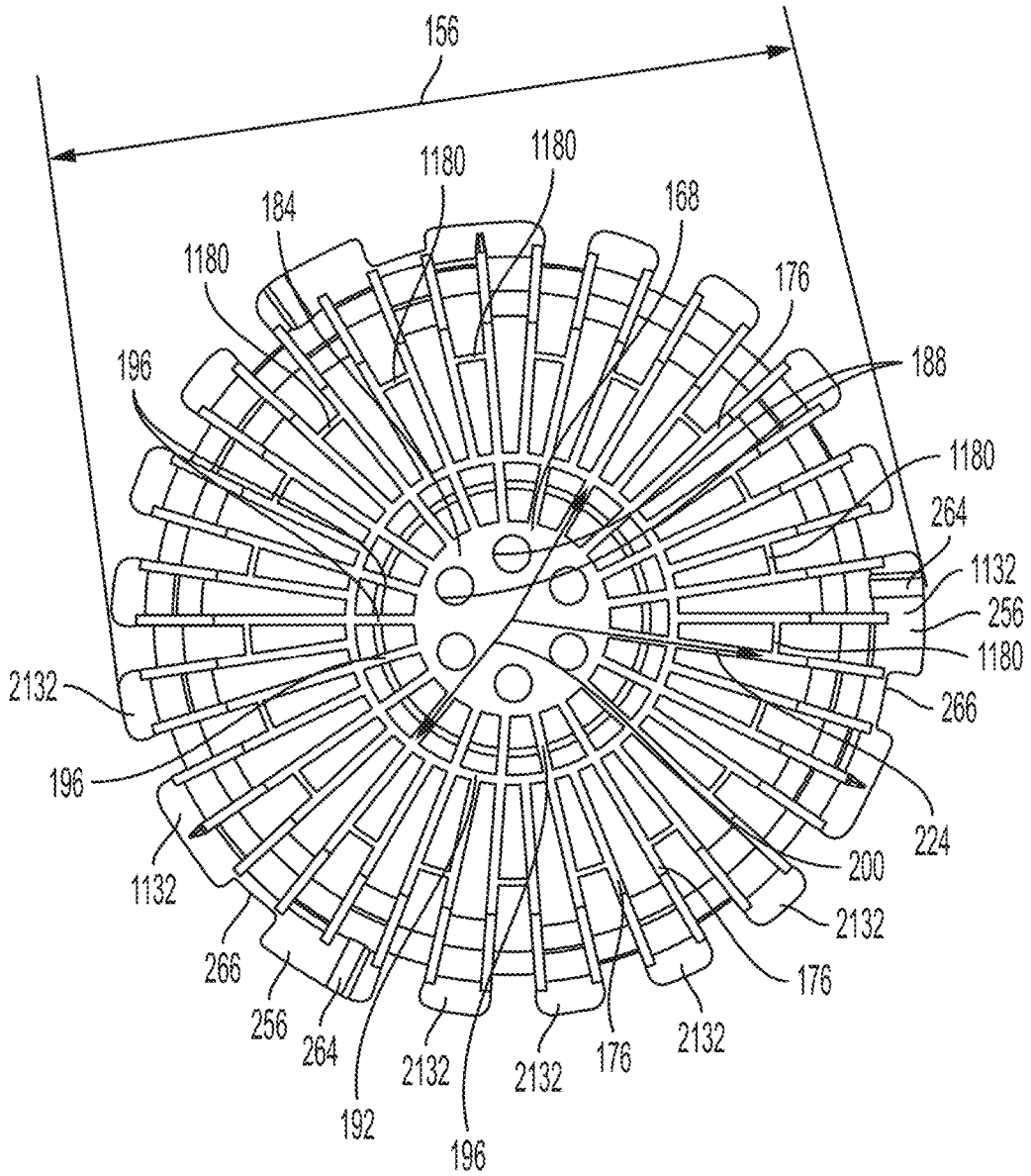
FIG. 10 is a top view of the dome of FIG. 9.
Figure 11:
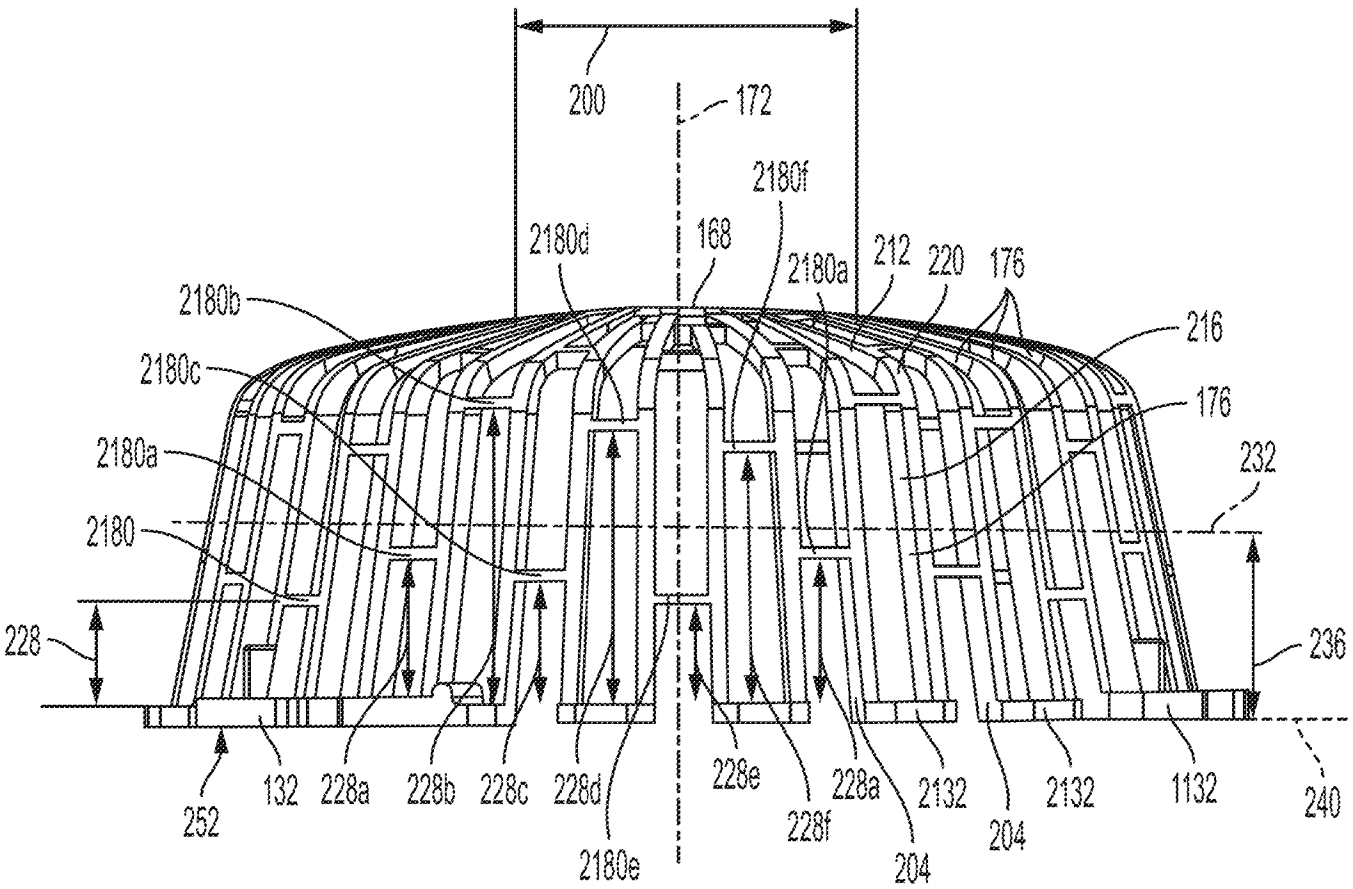
FIG. 11 is a side view of the dome of FIG. 9.

Illustrated in FIGS. 9-11, the dome 26 of the roof drain 10 is coupleable to the flange portion 46 of the base 10 and configured to at least partially enclose the inlet 40 of the channel 38. More specifically, the dome 26 acts as a filter by not allowing large items (e.g., rocks, sticks, and other debris) to enter the channel 38 during use. The dome 26 is also configured to maximize the volume of water that may flow into the channel 38 at any given time. The dome 26 does this by maximizing the percentage of the exterior surface area thereof that is open for water to pass therethrough for a given dome 26 size.

The dome 26 is substantially cylindrical in shape having an upper surface 160 and a side surface 164 extending along the perimeter for the upper surface 160. The dome 26 also includes a core element 168 defining a central axis 172, a plurality ribs 176 extending radially outwardly from the core element 168, and a plurality of crossbars 180 extending between and interconnecting select adjacent ribs 176. The core element 168 of the dome 26 is substantially disk shaped having a central disk 184 defining a plurality of apertures 188 therein, a concentric ring 192 spaced radially outward from the central disk 184, and a plurality of splines 196 extending radially between the central disk 184 and the concentric ring 192. The core element 168 also defines an outer core diameter 200. In alternative embodiments, additional styles and shapes of core elements may be present such as, but not limited to, a solid or perforated disk, a dish-shaped element, a plurality of concentrically located rings, a plurality of radially or otherwise oriented splines, and the like.

The ribs 176 of the dome 26 each extend radially outwardly from the core element 168 to produce a respective distal end 204. Together, the ribs 176 are generally spaced equally from one another in a circumferential direction to produce a plurality of equally sized gaps 208 therebetween. Each rib 176, in turn, includes a first leg or portion 212 extending radially outwardly from the core element 168, and a second leg or portion 216 extending from the first leg 212 at an angle with respect thereto to produce the distal end 204.

Each rib 176 also includes a bend or transition 220 where the first leg 212 and second leg 216 meet.

As shown in FIG. 9, the first leg 212 of each rib 176 is oriented substantially perpendicular to the axis 172 (e.g., forming an angle therebetween of approximately 70 and 100 degrees, for example 81 degrees) and generally corresponds with the upper surface 160 while the second leg 216 of each rib 176 is oriented substantially parallel to the axis 172 (e.g., forming an angle therebetween of approximately 0 and 20 degrees, for example 12 degrees) and generally corresponds with the side surface 165 of the dome 26. In still other embodiments, the first leg 212 and the second leg 216 form an angle therebetween of approximately 90 to 120 degrees, for example 112 degrees.

The crossbars 180 of the dome 26 extend between and are coupled to adjacent ribs 176. Each crossbar 180 is generally positioned at various locations along the lengths of the ribs 176 and oriented substantially perpendicular thereto. As shown in FIG. 9, the crossbars 180 are positioned such that no crossbars 180 are located at the transition 220 between the first leg 212 and the second leg 216 (e.g., the transition 220 region of the dome 26 is not completely enclosed). Stated differently, each gap 208 of the dome 26 is open at the transition 220. The crossbars 180 are also position such that each crossbar 180 is not aligned with any crossbars 180 positioned in the adjacent gaps 208. While the illustrated crossbars 180 are generally elongated in shape and oriented perpendicular to the corresponding ribs 176, it is understood that in alternative embodiments the crossbars 180 may have different sizes and shapes and be oriented at various angles relative to the ribs 176.

In the illustrated embodiment, the dome 26 includes a first set of crossbars 1180 and a second set of crossbars 2180. Each crossbar 1180 of the first set of crossbars extends between the first legs 212 of the ribs 176 and are each located at a first radial distance 224 from the axis 172. As shown in FIG. 10, the first set of crossbars 1180 are located in every-other gap 208 around the circumference of the dome 26. In the illustrated embodiment, the first radial distance 224 is greater than the outer core diameter 200 but less than the diameter at which the transition 220 is located. In alternative embodiments, the first set of crossbars 1180 may be positioned in different patterns such as, but not limited to, having each crossbar 1180 at a different radial distance than adjacent crossbars; having the crossbars spiral radially outwardly or inwardly, having a random pattern where no adjacent crossbars align, and the like.

Each crossbar 2180 of the second set of crossbars extends between the second legs 216 of the ribs 176 at a corresponding "bar height" 228. For the purposes of this application, the bar height 228 is generally defined as the distance between the crossbar 180 and the distal end 204 of the corresponding rib 176.

The second set of crossbars 2180 are generally positioned so that they alternate above and below a datum plane 232 oriented normal to the axis 172 and located at a predetermined datum height 236. For the purposes of this application, the datum height 236 is generally defined as the axial distance between the datum plane 232 and the base plane 240 of the dome 26 (described below). In some embodiments, the datum plane 232 may be positioned at the midpoint such that the datum height 236 is half the overall axial height 244 of the dome 26. In other embodiments, the datum plane 232 may be positioned at different datum heights 236 to accommodate different flow patterns.

As shown in FIG. 11, the second set of crossbars 2180 are positioned such for a given crossbar 2180, both adjacent crossbars 180*b* are located to one side thereof (e.g., either above or below). For example, for a select crossbar 2180 having a given bar height 228, both adjacent crossbars 2180 will have a bar height 228 that is either both greater than or both less than the given bar height 228.

More specifically, the second set of crossbars 2180 are positioned to produce a repeating pattern about the circumference of the dome 26. Specifically, the first crossbar 2180*a* of the pattern includes a first bar height 228*a*, the subsequent second crossbar 2180*b* has a second bar height 228*b* that is greater than the first bar height 228*a*, the subsequent third crossbar 2180*c* has a third bar height 228*c* that is less than the second bar height 228*b*, the subsequent fourth crossbar 2180*d* has a fourth bar height 228*d* that is greater than the third bar height 228*c*, the subsequent fifth crossbar 2180*e* has a fifth bar height 228*e* that is less than the fourth bar height 228*d*, and the subsequent sixth crossbar 2180*f* has a sixth bar height 228*f* that is greater than the fifth bar height 228*e*. In instances where six crossbars 2180 are included in the pattern, the sixth bar height 228*f* is also greater than the first bar height 228*a*. However, in alternative embodiments, additional or fewer crossbars 2180 may be included in the pattern as necessary (e.g., four crossbars, five crossbars, seven crossbars, eight crossbars, nine crossbars, and the like).

As shown in FIG. 11, in addition to the alternating pattern of the crossbars 2180 described above, the second set of crossbars 2180 also step-down (e.g., the bar heights 228 reduce) as the pattern progresses. For example, for the sub-set of crossbars 2180 positioned above the datum plane 232 (e.g. the second, fourth, and sixth crossbars 2180*b*, 2180*d*, 2180*f*) the fourth bar height 228*d* is less than second bar height 228*b* and the sixth bar height 228*f* is less than the fourth bar height 228*d*. With respect to the sub-set of crossbars 2180 positioned below the datum plane 232 (e.g., the first, third, and fifth crossbars 2180*a*, 2180*c*, 2180*e*), the third bar height 228*c* is less than the first bar height 228*a* and the fifth bar height 228*e* is less than the third bar height 228*c*. Viewed together as a group, none of the six crossbars 2180 in the repeating pattern have the same bar height 228 (e.g., the first, second, third, fourth, fifth, and sixth bar heights 228*a-f* are all different).

Figure 23:
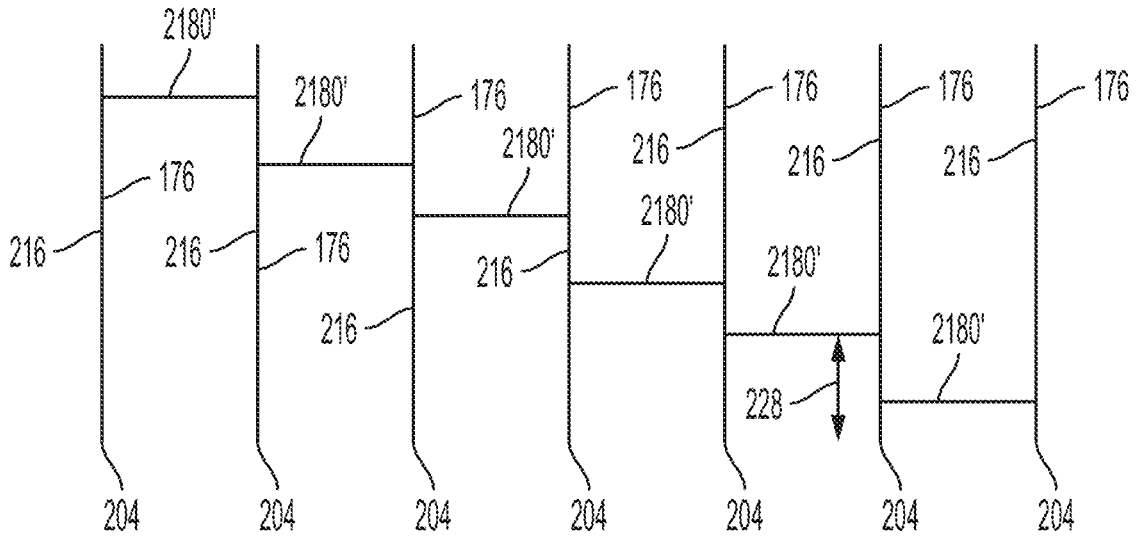
FIGS. 23-26 illustrate alternative embodiments of the crossbars of the dome.

FIG. 23 illustrates another embodiment of the second set of crossbars 2180'. The second set of crossbars 2180' produce a "step-down" pattern where each crossbar 2180' has a bar height 228 that is less than the previous crossbar 2180' when taken in a given rotational direction. In such embodiments, the illustrated pattern may repeat over the circumference of a given dome. While the illustrated pattern shows six crossbars 2180', it is understood that more or fewer crossbars 2180' may be present.

Figure 24:
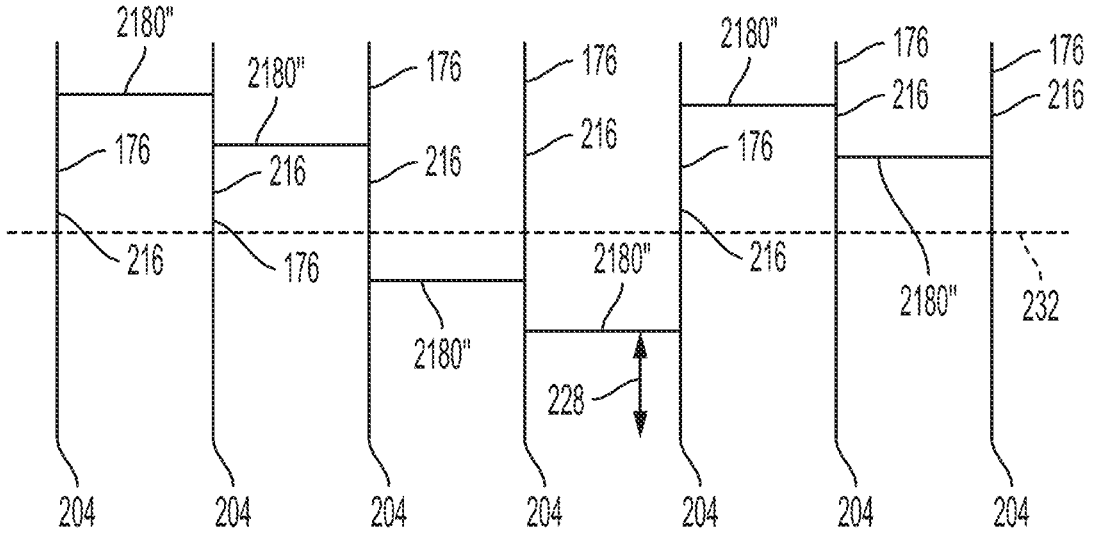

FIG. 24 illustrates another embodiment of the second set of crossbars 2180". The second set of crossbars 2180" generally produces an alternating pattern where groups of crossbars 2180" (e.g., two crossbars) alternate above and below the datum 232. While the illustrated embodiment includes two crossbars 2180" in each group, alternative embodiments may include more or fewer crossbars 2180" in each group. Furthermore, while the illustrated embodiment shows the crossbars 2180" in a given group not aligning with each other, it is understood that in some embodiments the crossbars 2180" within a given group may align with each other.

Figure 25:
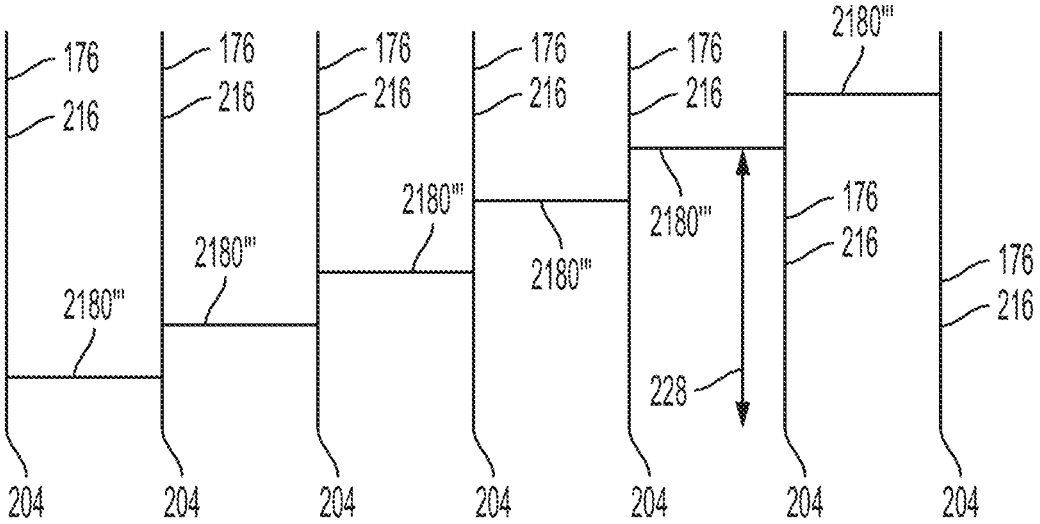

FIG. 25 illustrates another embodiment of the second set of crossbars 2180"". The second set of crossbars 2180"' generally produces a "step-up" pattern where each crossbar 2180"" has a bar height 228 that is greater than the previous crossbar 2180''' when taken in a given rotational direction. In such embodiments, the illustrated pattern may repeat over the circumference of a given dome. While the illustrated pattern shows six crossbars 2180''', it is understood that more or fewer crossbars 2180''' may be present.

Figure 26:
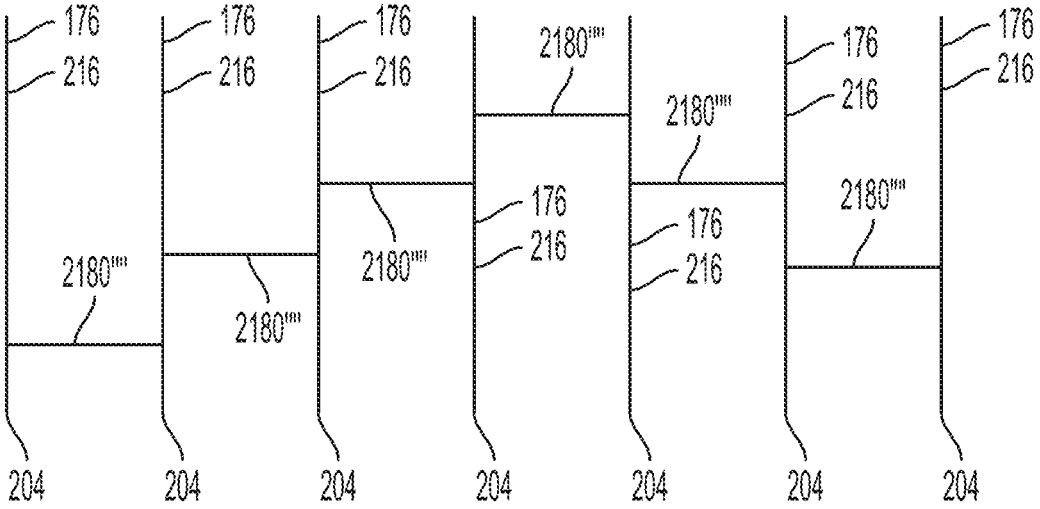

FIG. 26 illustrates another embodiment of the second set of crossbars 2180''''. The second set of crossbars 2180'''' generally produces a "chevron" pattern where the crossbars 2180'''' alternate between step-up and step-down patterns. In the illustrated embodiment, the alternating step-up and step-down patterns continue over the entire circumference of the dome.

While the illustrated crossbars 180 are oriented as described above, it is understood that additional patterns may be present. Furthermore, the pattern may be expanded to include more or fewer crossbars 180 as necessary and to accommodate different numbers of ribs 176 and dome 26 sizes.

The dome 26 also includes a set of base plates 132, each coupled to the distal end 204 of one or more ribs 176 and configured to support the dome 26 on the base 18. In the illustrated embodiment, the base plates 132 do not completely enclose the bottom of the dome 26, rather, at least one of the gaps 208 between adjacent ribs 176 are open (e.g., not enclosed at the bottom of the dome 26). When the drain 10 is assembled, the base plates 132 are positioned completely axially below the top plane 96. Furthermore, the gaps between the base plate 132 also extend axially below the top plane 96. As shown in FIG. 4, the base plates 132 are also positioned below the finished surface 146 of the roof 14 positioned immediately adjacent to the drain 10. For the purposes of this application, the finished surface 146 of the roof 14 is defined as the surface of the roof on which gravel is laid immediately adjacent to the drain 10. In FIG. 4, the finished surface 146 is the top surface of the roof paper 152, however, the finished surface 146 may include the top surface 130 of the roof 14 (e.g., when no paper 152 is present) or the top surface of a deck plate immediately adjacent to the drain 10 (not shown) when used. The gaps between the base plates 132 also extend below the finished surface 146 of the roof 14 positioned immediately adjacent to the drain 10.

As shown in FIG. 9, the base plates 132 of the dome 26 include a first set of locating base plates 1132 and a second set of intermediate base plate 2132. Together, the first set and second set of plates 1132, 2132 define a base plane 240 of the dome 26. As shown in FIG. 11, the base plane 240 is generally oriented substantially normal to the axis 172. In the illustrated embodiment, the bottom surfaces 252 of the base plates 132 are all slightly angled relative to the axis 172 so that bottom surfaces 252 substantially match and align with the flange portion 46 of the base 18 (e.g., the third portion 120). However, in alternative embodiments it is understood that the bottom surfaces 252 may be normal to the axis 172 or contoured as necessary to accommodate the base 18 and the gravel ring 30. In some embodiments, protrusions or grooves may be included to aid the alignment between the dome 26, gravel ring 30, and base 18. Together, the base plates 132 also define an outer diameter 156 of the dome.

The first set of base plates 1132 are each substantially elongated in shape extending along and being coupled to one or more distal ends 204 of the ribs 176. During use, the first set of base plate 1132 generally form locking members 256 and are configured to interact with and releasably couple to the gravel ring 30. In the illustrated embodiment, the dome 26 includes three first base plates 1132, each positioned so that they generally correspond and align with a respective locking member 260 of the gravel ring 30 (described below).

The locking members 256 of the dome 26 are configured to both restrict the axial movement of the dome 26 relative to the base 18 (e.g., clamp the dome 26 to the base 18) and rotationally orient the dome 26 relative to both the base 18 and gravel ring 30. As shown in FIG. 9, the illustrated locking members 256 each include a locking ridge 264 and define a locking notch 266 open to the radially outermost edge thereof.

The second set of base plates 2132 are each configured to strengthen and enclose adjacent ribs 176 of the dome 26. As shown in FIG. 9, each base plate 2132 of the second set of base plates extends between and is coupled to the distal ends 204 of adjacent ribs 176. Together, the base plates 2132 are generally spaced apart so that they form alternating open and closed gaps 208 between the ribs 176. While the illustrated plates 2132 are shown to be positioned in every other gap 208, it is understood that in alternative embodiments the size (e.g., the number of ribs 176 an individual base plate 2132 is coupled to) and spacing (e.g., the number of open gaps 208 between adjacent base plates 2132) may be adjusted as needed.

Figure 12:
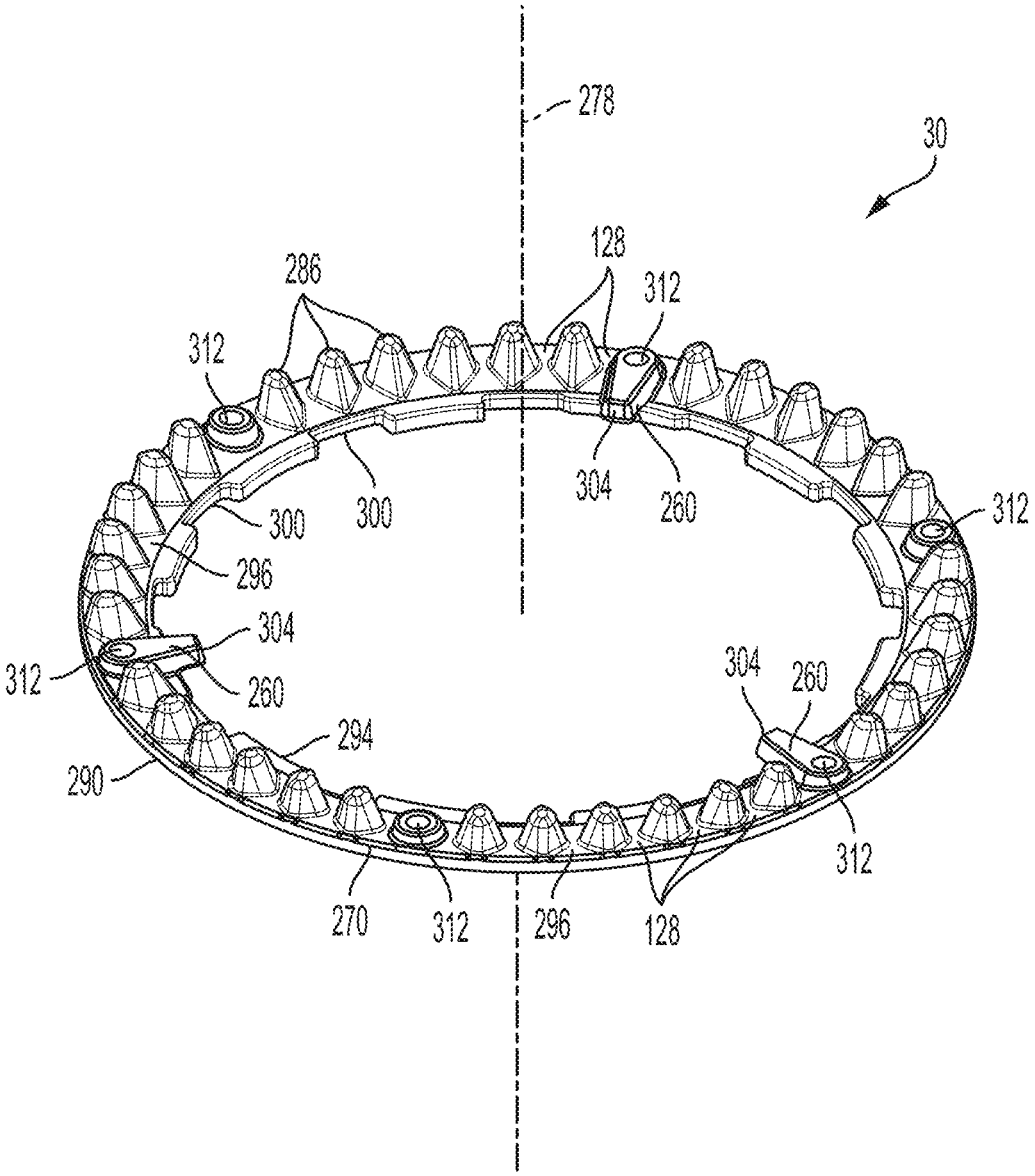
FIG. 12 is a perspective view of a gravel ring of the drain of FIG. 1.
Figure 13:
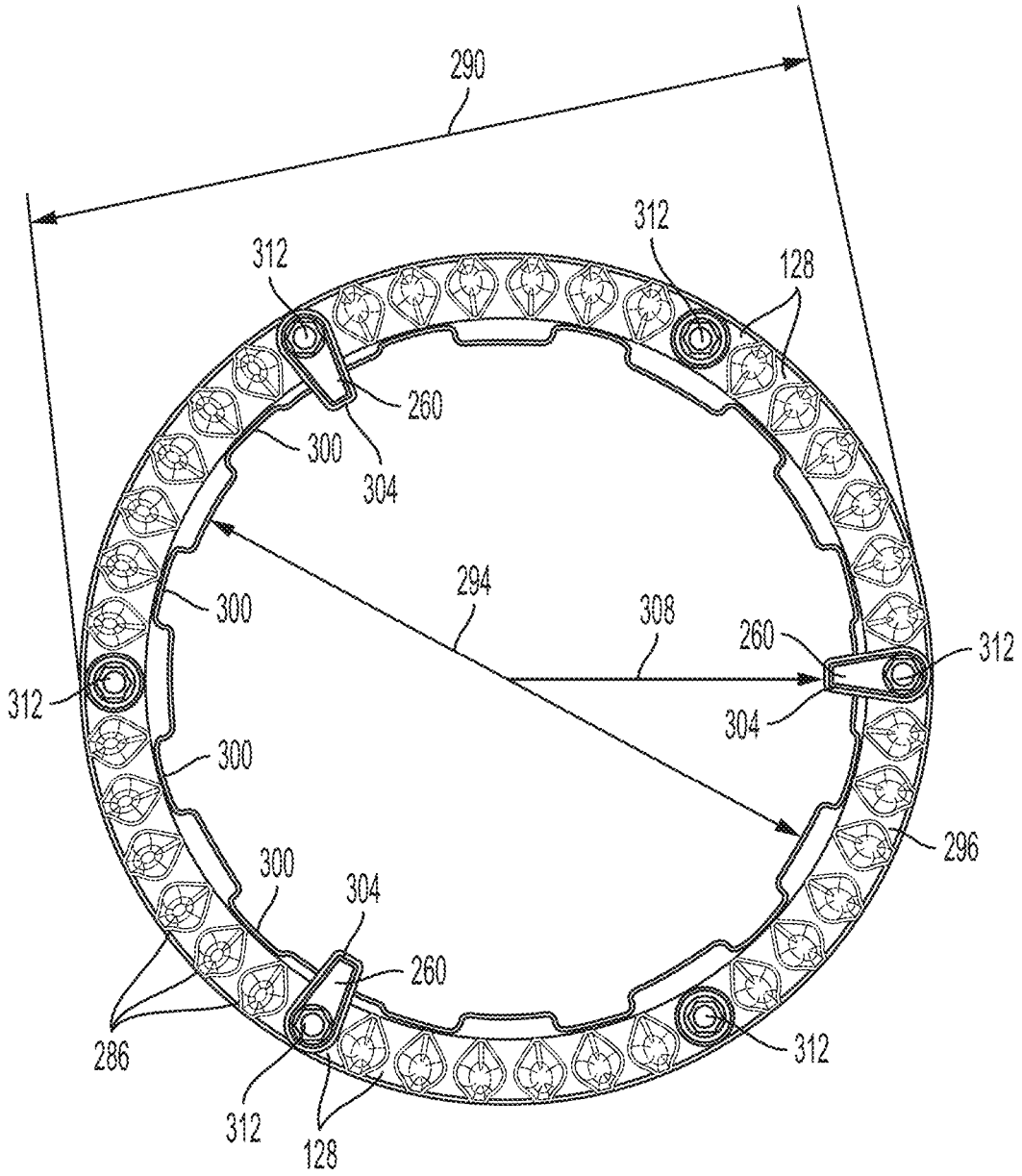
FIG. 13 is a top view of the gravel ring of FIG. 12.
Figure 14:
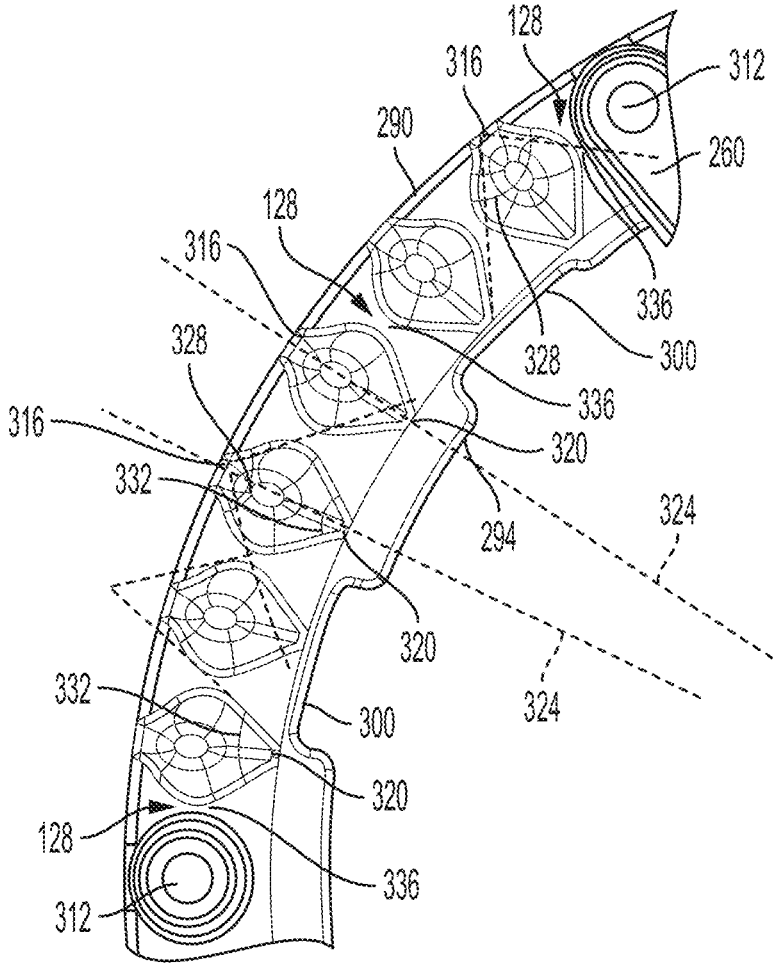
FIG. 14 is a detailed top view taken from FIG. 13.

FIGS. 12-14 illustrate the gravel ring 30 of the roof drain 10. The gravel ring 30 is generally configured to releasably couple the dome 26 to the base 18 in addition to acting as a preliminary filter by restricting the flow of large debris (e.g., gravel, sticks, garbage, and the like) from flowing into the dome 26 and/or channel 38. During installation, the gravel ring 30 is also configured to secure the roof paper 152 to the base 18 of the drain 10.

As shown in FIG. 12, the gravel ring 30 is substantially disk shaped having an annular body 270 defining an outer diameter 274 and an axis 278 therethrough. The gravel ring 30 also includes a plurality of locking members 260, and a plurality of teeth 286.

The body 270 of the gravel ring 30 is annular in shape and defines an outer diameter 290, an inner diameter 294, and an upper surface 296. As shown in FIG. 13, the inner diameter 294 of the body 270 includes a plurality of notches 300 formed therein. Each notch 300 extends radially outwardly (e.g., into the body 270) and is equally spaced along the circumference of the inner diameter 294. During use, the notches 300 allow the user to more easily identify the roof paper 152 when installing the drain 10 onto a roof 14. More specifically, by having the notches 300 formed therein, the user is not required to have as much sheeting inside the drain 10 to satisfy the "visible length" code requirements. Since the presence of roof paper 152 near the channel 38 can disrupt flow patterns and reduce overall flow capacity, minimizing the amount of paper 152 can improve flow characteristics of the drain 10. While the illustrated notches 300 are sized and shape equally about the circumference of the body 270, in alternative embodiments, more or fewer notches 300 may be present. Furthermore, the size and the shape of the notches 300 may vary with respect to one another.

Figure 1:
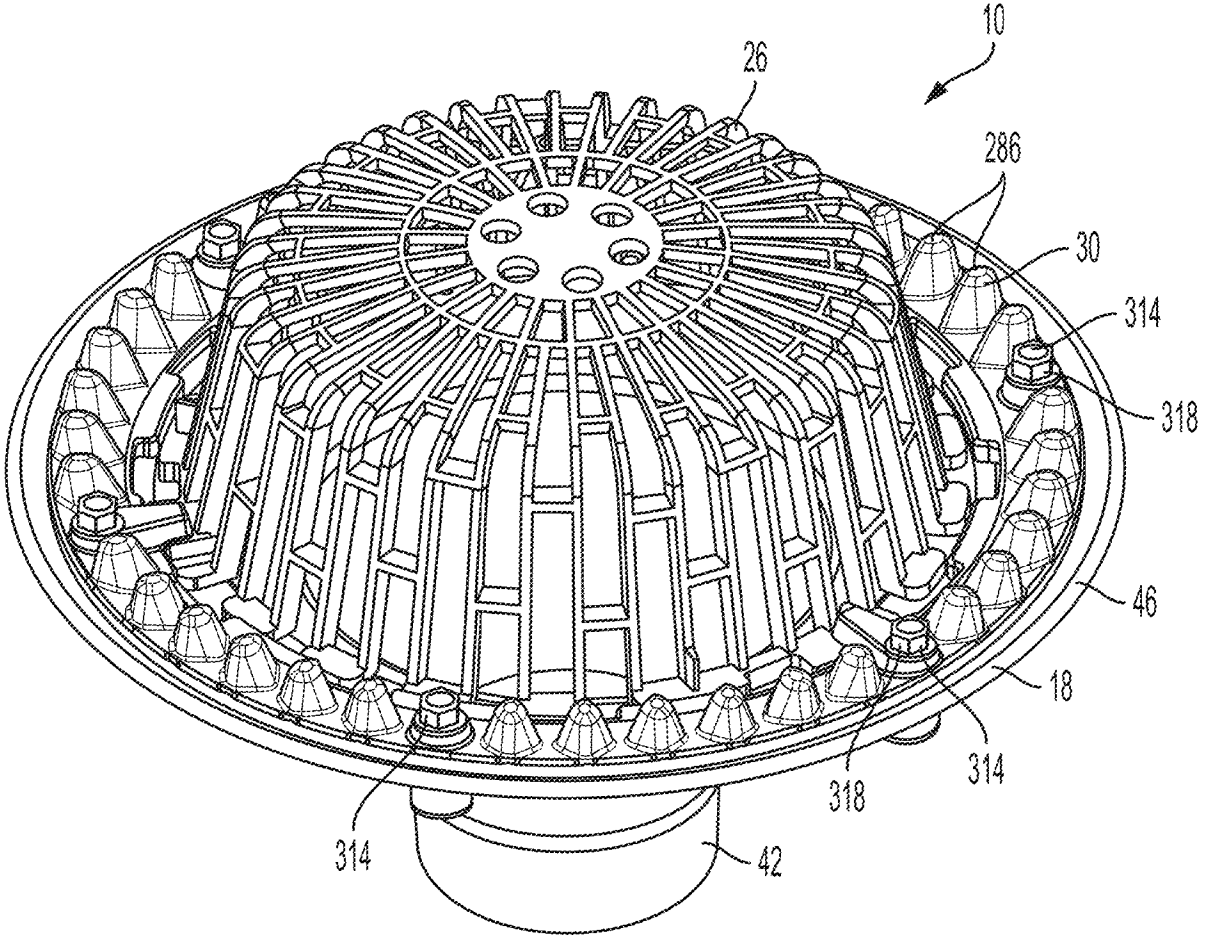
FIG. 1 is a perspective view of drain of the present invention.
Figure 2:
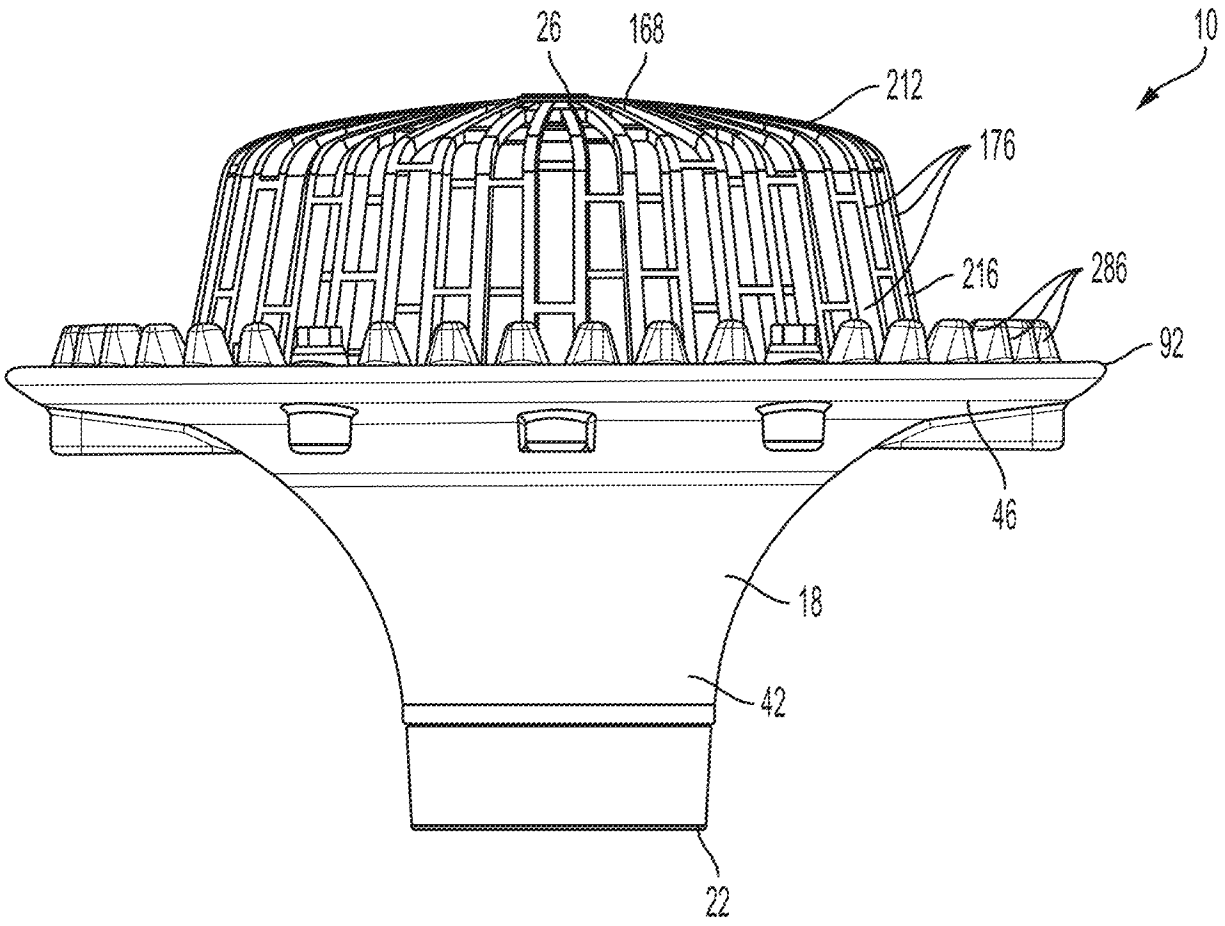
FIG. 2 is a side view of the drain of FIG. 1.
Figure 3:
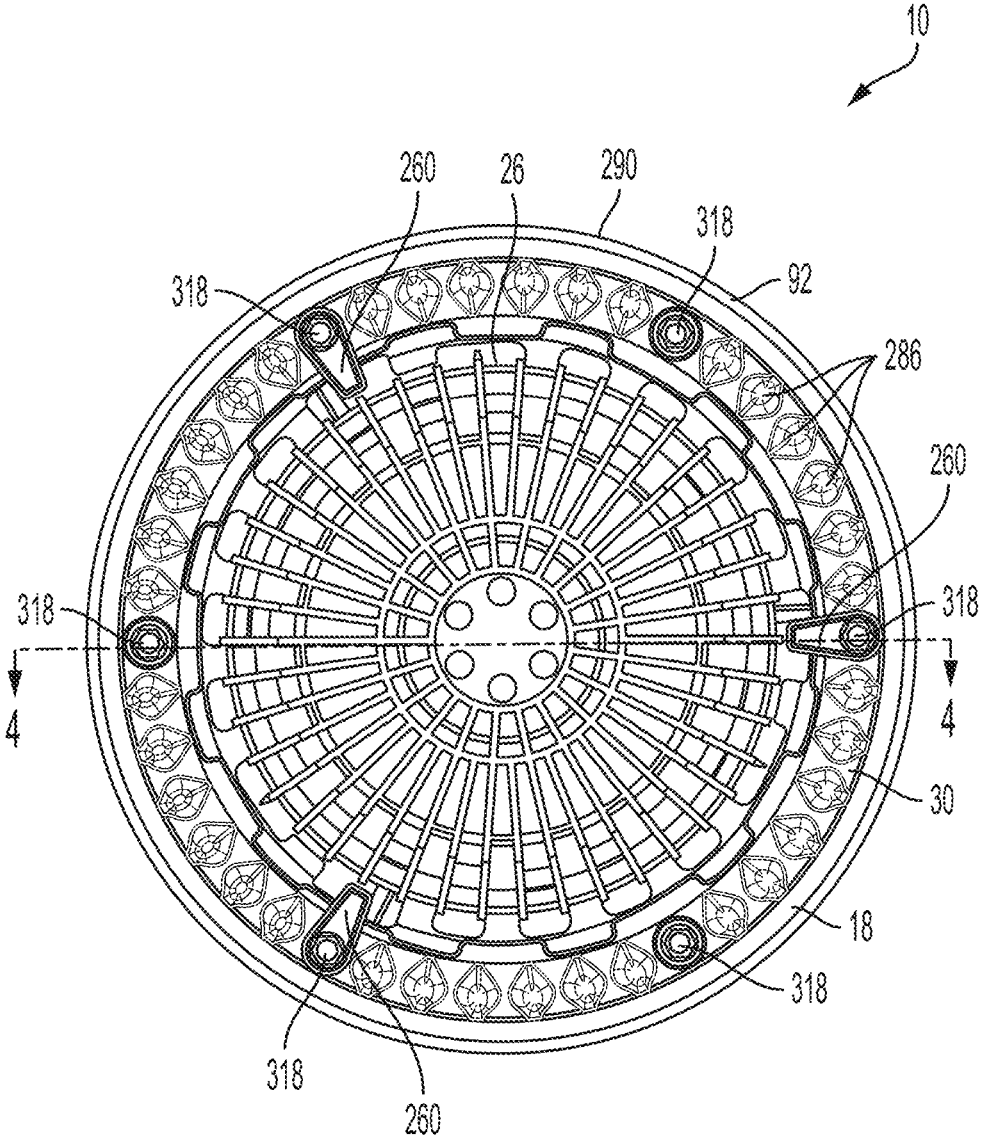
FIG. 3 is a top view of the drain of FIG. 1.

The locking members 260 of the gravel ring 30 are configured to releasably engage with the locking members 256 of the dome 26. More specifically, the locking members 260 of the gravel ring 30 are configured to axially lock the dome 26 against the base 18 while also rotationally aligning the ring 30, dome 26, and base 18. In the illustrated embodiment, the locking members 260 of the gravel ring 30 include a plurality of tabs extending radially inwardly from the body 270 to produce a distal end 304 at a distal end diameter 308. As shown in FIG. 3, the distal end diameter 308 is less than the outer diameter 154 of the dome 26.

The teeth 286 of the gravel ring 30 extend axially from upper surface 296 of the body 270 and are spaced in equal groups about the circumference thereof. More specifically, the illustrated teeth 286 include six groups of six equally spaced teeth 286, each separated by a corresponding bolt aperture 312. Together, the teeth 286 and bolt apertures 312 are all equally spaced about the circumference of the gravel ring 30 and generally located at the same radial distance from the axis 278 (e.g., on the same reference circle centered on the axis 278). As such, when the gravel ring 30 is installed, the head 314 of the fasteners 318 positioned in the bolt apertures 312 serve to act as a "tooth" in the gravel ring 30. By doing so, the fasteners 318 are both easily accessible by the user while minimizing any restrictions to the water flow past the ring 30 itself. As shown in FIG. 4, bolt apertures 312 are positioned radially outside the dome 26.

As shown in FIG. 14, each tooth 286 is substantially "diamond" shaped having a leading point 316 positioned proximate the outer diameter 290 of the body 270, and a trailing point 320 positioned proximate the inner diameter 294 of the body 270. As shown in FIG. 14, the leading point 316 and trailing point 320 of each tooth 286 falls on a datum line 324 extending radially from the axis 278.

Each tooth 286 also includes a leading angle 328 and a trailing angle 332. For the purposes of this application, the leading angle 328 is generally defined as the angle at which the tooth 286 extends from the leading point 316 while the trailing angle 332 is generally defined as the angle at which the tooth 286 extends from the trailing point 320. As shown in FIG. 14, the leading angle 328 is greater than the trailing angle 332. Each tooth 286 is also shaped so that it tapers as it extends axially from the upper surface 296 body 270.

The gravel ring 30 also includes a plurality of gullets 128 formed between a corresponding pair of teeth 286, between a tooth 286 and bolt aperture 312 (e.g., the head 314 of the fastener 318 positioned in the bolt aperture 312), or between a tooth 286 and a locking member 260. The gullets 128, are equally spaced about the entire circumference of the gravel ring 30, including those gullets 128 associated with the bolt apertures 312 and locking members 260.

Each gullet 128, in turn, includes a low point or bottom 336. In the illustrated embodiment, the low point 336 of the gullets 128 lie directly on the upper surface 296 of the body 270. As shown in FIG. 5, the gullets 128 are configured such that, when the gravel ring 30 is attached to the base 18, the low point 336 of at least one gullet 128 is positioned axially beneath the top plane 96. In the illustrated embodiment, each low point 336 is positioned below the top plane 96. Furthermore, the low point 336 of at least one gullet 128 is positioned below the finished surface 146 of the roof 14 immediately adjacent to the drain 10.

In the illustrated embodiment, the number of gullets 128 on the gravel ring 30 and the number of gaps 208 in the dome 26 are multiples of one another. As such, when both the gravel ring 30 and dome 26 are attached to the base 18 (and rotationally aligned using the locking members 256, 260), each of the gullets 128 may be radially aligned with a corresponding gap 208 (e.g., when the number of gullets 128 is less than or equal to the number of gaps 208) or each gap 208 may be radially aligned with a corresponding gullet 128 (e.g., when the number of gaps 208 is less than or equal to the number of gullets 128). This arrangement allows for a more efficient and direct flow path for water to enter the channel 38 during use. In the illustrated embodiment, the number of gullets 128 equals the number of gaps 208.

While the illustrated drain 10 is shown being substantially circular in shape, it is understood that in alternative embodiments, the drain 10 may be rectangular, square, oval, or polygonal in shape.

To install the drain 10 on a roof 14, the user places the base 18 such that the outer edge 92 of base 18 is located substantially level with the top surface 130 of the roof 14 (e.g., the top plane 96 is aligned with the top surface 130; see FIG. 4). With the base 18 located, the user may then secure the drain 10 in place by bolting the base 18 to the roof 14 with fasteners (e.g., using threaded apertures 144 on the bottom side thereof). The user may also attach the outlet 22 of the drain 10 to the building plumbing system 34.

With the base 18 in place, the user may then apply a layer of roof paper 152 to the top surface 130 of the roof 14. When doing so, the user lays the paper 152 over the outer edge 92 so it generally covers the base 18. With the paper 152 roughly positioned, the user may then attach the gravel ring 30 to the base 18. To do so, the user axially places the gravel ring 30 onto the flange portion 46, making sure to align the bolt apertures 312 of the ring 30 with the corresponding threaded apertures 136 of the base 18. The user may then secure the ring 30 to the base 18 using a series of threaded fasteners 318 (see FIG. 1).

With the ring 30 in place, the user may then trim the roof paper 152 by running a blade (e.g., a razor blade or knife) along the cutting groove 148 of the base 18. By doing so, the cutting groove 148 will guide the blade along the desired cutting path, allowing the user to remove the portion of the paper 152 generally covering the channel 38. As described above, the cutting groove 148 is positioned such that the appropriate length and shape of paper 152 remains attached to the drain 10 as required by code. Furthermore, the notches 300 of the gravel ring 30 are positioned such that an increased length of roof paper 152 is exposed after the excess paper has been removed (e.g., the exposed radial length of paper 152 equals the radius of the interior of the notch 300 minus the radius at which the cutting groove 148 is located).

Finally, the user may install the dome 26. To do so, the user aligns each locking member 260 of the gravel ring 30 with a corresponding locking member 256 of the dome 26. More specifically, the user aligns the elements to that the of the gravel ring 30 with a corresponding locking notch 266 of the dome 26. The dome 26 is then axially directed onto the base 18 until the bottom surfaces 252 of the dome 26 contacts the flange portion 46 of the base 18. By doing so, each locking member 260 passes through their corresponding notch 266.

Once in place, the user can then rotate the dome 26 relative to the base 18 and gravel ring 30 causing each locking member 260 to pass over the top of its corresponding base plate 132 until each locking member 260 contacts a respective locking ridge 264. With the locking member 260 in contact with the ridge 264, the dome 26 and ring 30 are rotationally aligned such that the gullets 128 of the ring 30 radially align with the gaps 208 of the dome 26.

Figure 15:
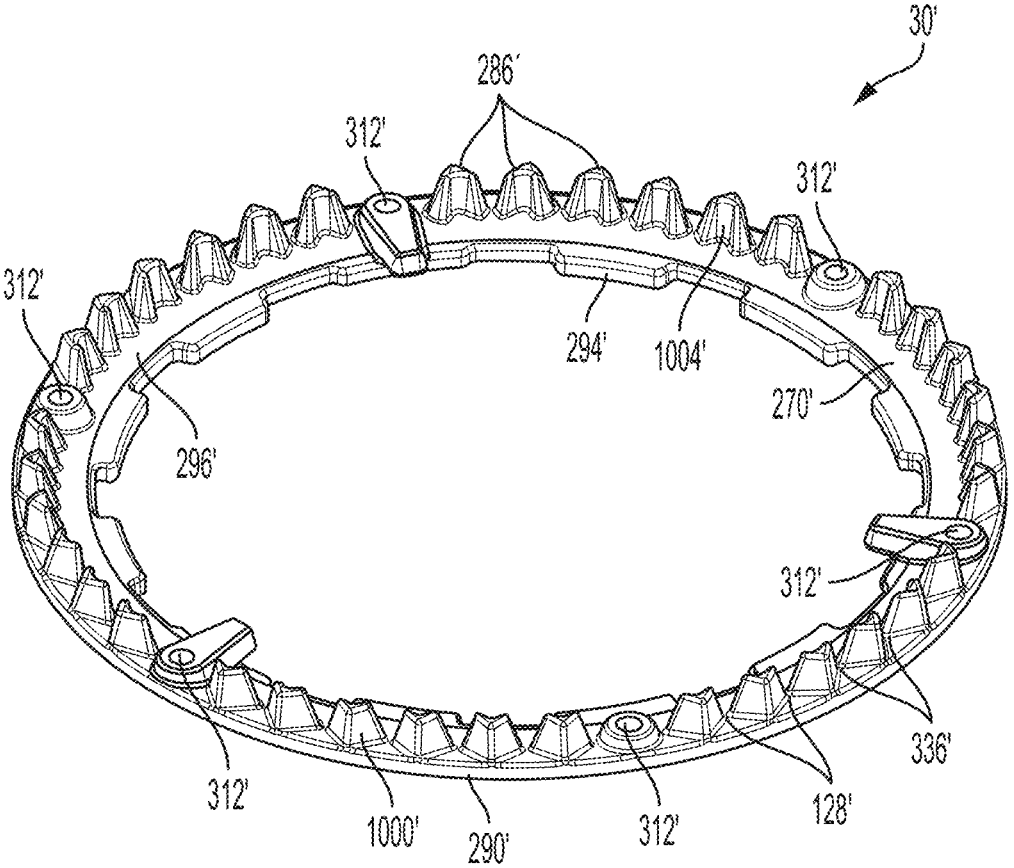
FIG. 15 is another embodiment of a gravel ring.
Figure 16:
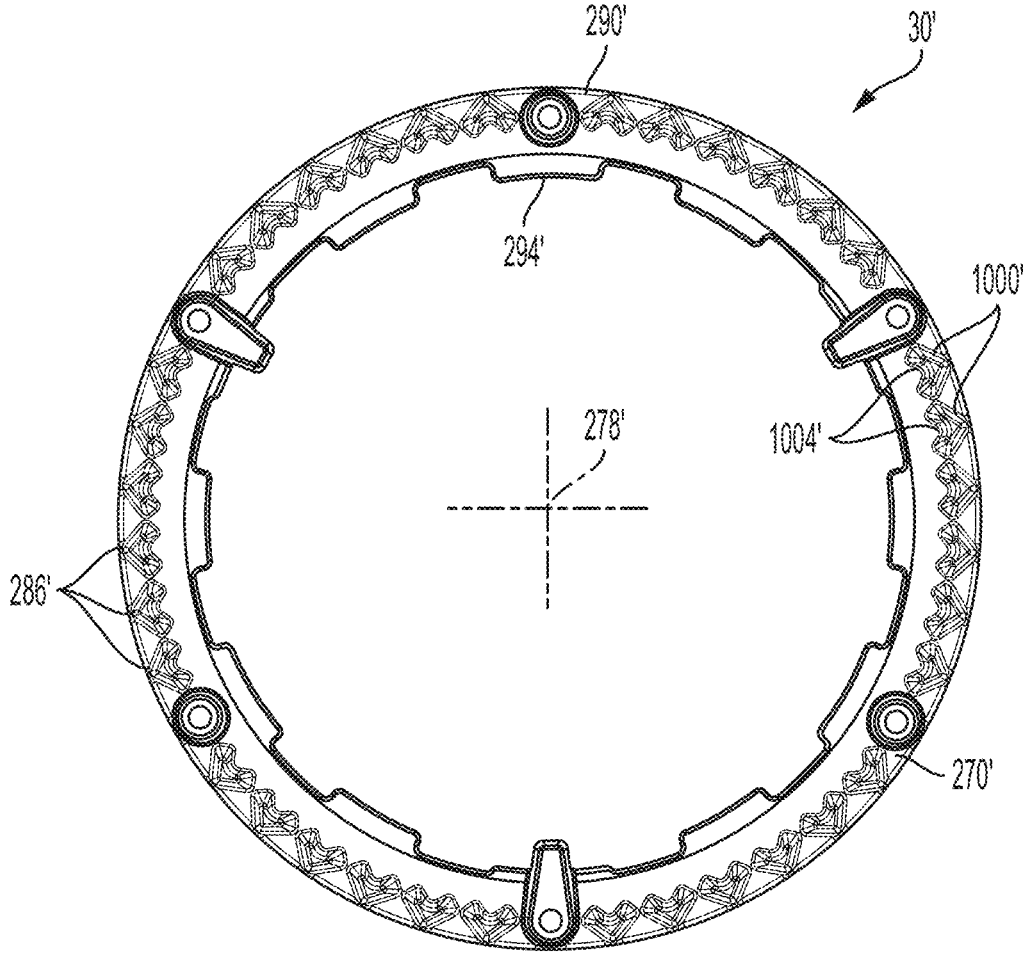
FIG. 16 is a top view of the gravel ring of FIG. 15.
Figure 17:
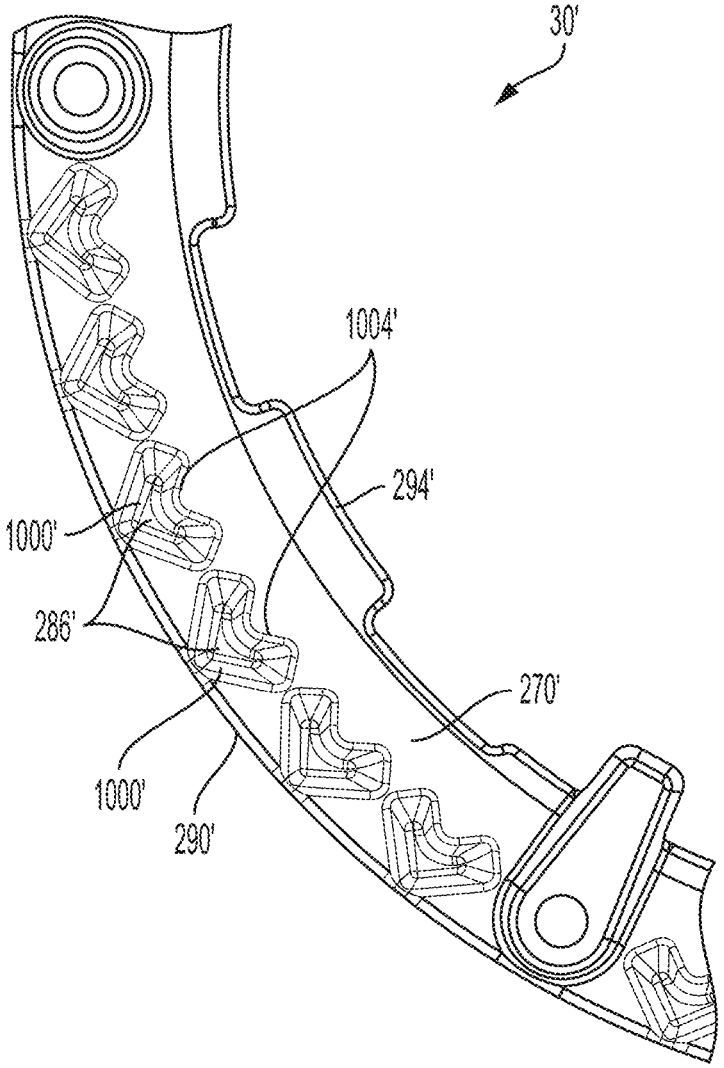
FIG. 17 is a detailed top view taken from FIG. 16.

FIGS. 15-17 illustrate another embodiment of the gravel ring 30'. The gravel ring 30' is substantially similar to the gravel ring 30 so only the difference will be discussed in detail herein. The gravel ring 30' includes a plurality of teeth 286', and one or more bolt apertures 312'. Together, the teeth 286' and bolt apertures 312' are equally spaced along the circumference of the body 270' of the ring 30' with a gullet 128' being formed between each element. As shown in FIG. 16, both the teeth 286' and bolt apertures 312' are all located substantially the same radial distance from the axis 278'.

The gravel ring 30' includes a plurality of teeth 286' having a substantially chevron shape. More specifically, each tooth 286' includes a leading surface 1000' positioned proximate to and facing the outer diameter 290' of the ring 30' body 270', and a trailing surface 1004' opposite the leading surface 1000' and facing the inner diameter 294' of the body 270'. Each tooth also narrows as it extends axially from the body 270'.

The leading surface 316' is substantially convex, extending outwardly away from the tooth 286. In the illustrated embodiment the leading surface 316' includes a pair of planar surfaces set at an angle relative to one another to form a point 1008' and facing radially outwardly. More specifically, the planar surfaces are oriented such that they extend away from each other as they extend radially inwardly. In alternative embodiments, the leading surface 316' may include a single, convex curved surface as well.

The trailing surface 1004' is substantially concave, extending inwardly into the tooth 286. In the illustrated embodiment, the trailing surface 1004' includes a curved concave surface. However, in alternative embodiments multiple planar surfaces may also be used.

The gullets 128' of the ring 30' each include a low point or bottom 336" that, when installed on a base 18, is below the top plane 96. In the illustrated embodiment, the bottom 336' of the gullet 128' is coincident with the top surface 296' of the body 270'. Furthermore, the illustrated ring 30" includes the same number of gullets 128' as the number of gaps 208 in the dome 26. In alternative embodiments, the ring 30' may include a number of gullets 128' that is a multiple of the number of gaps 208 in the dome 26.

Figure 18:
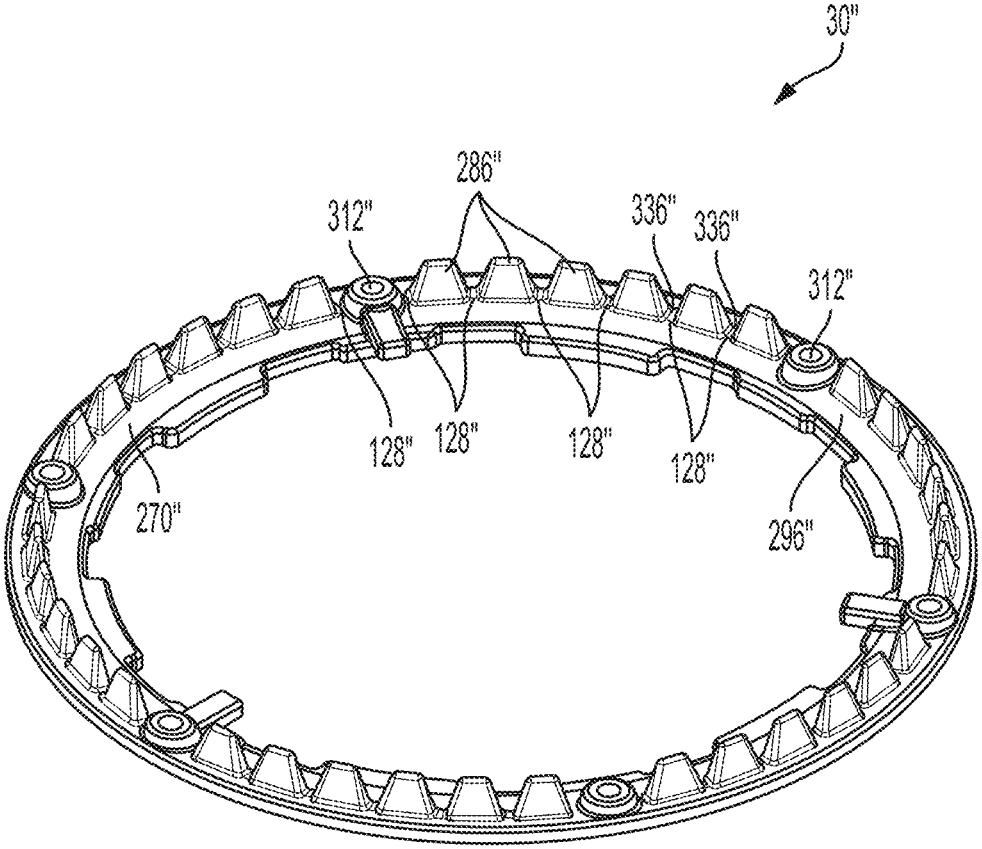
FIG. 18 is a perspective view of another embodiment of a gravel ring.
Figure 19:
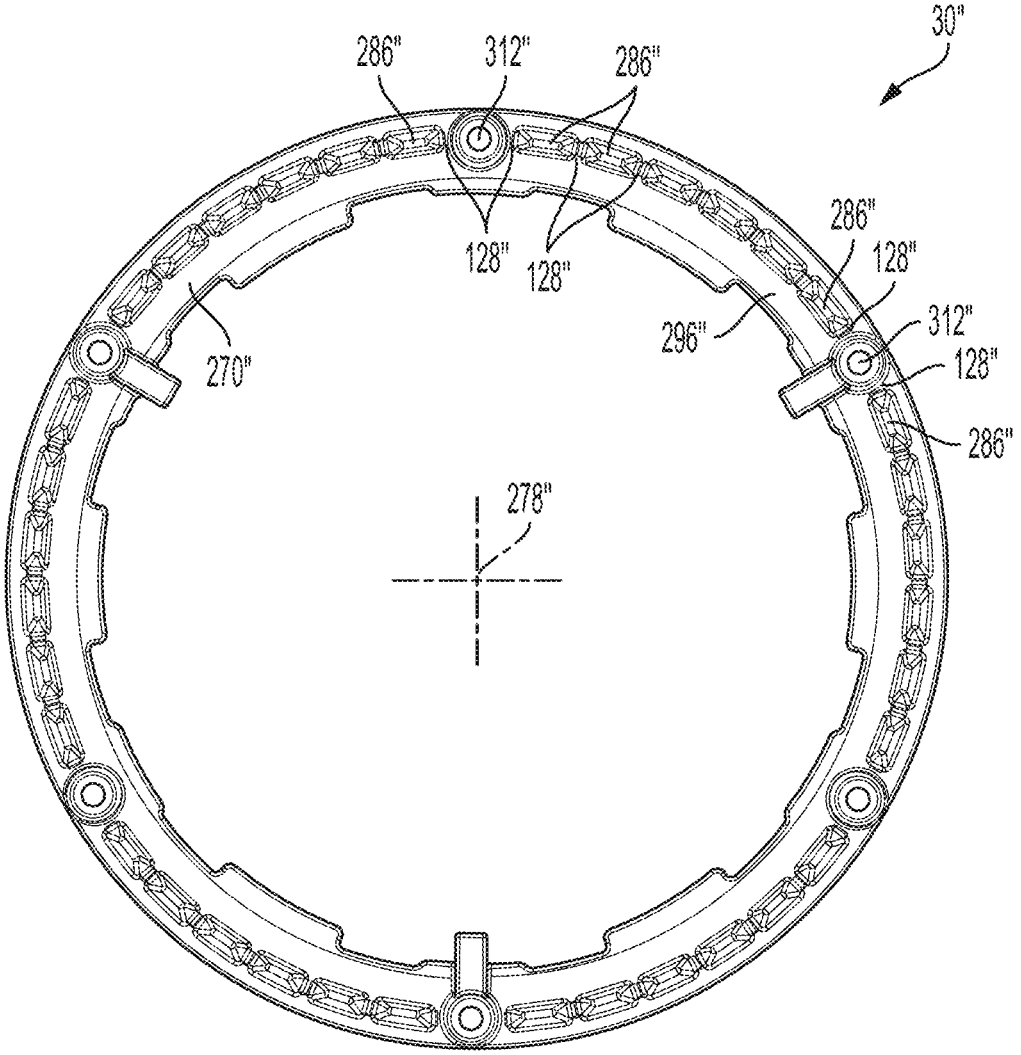
FIG. 19 is a top view of the gravel ring of FIG. 18.
Figure 20:
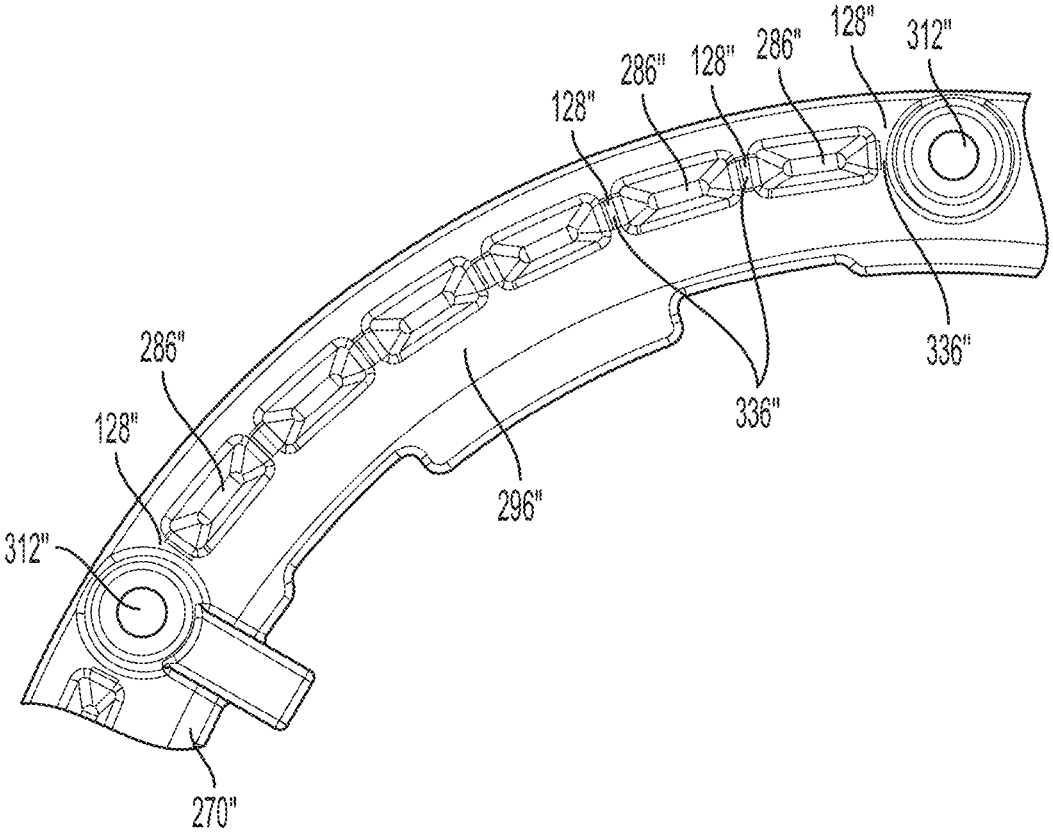
FIG. 20 is a detailed top view taken from FIG. 19.

FIGS. 18-20 illustrate another embodiment of the gravel ring 30". The gravel ring 30" is substantially similar to the gravel ring 30 so only the differences will be discussed in detail herein. The gravel ring 30" includes a plurality of teeth 286", and one or more bolt apertures 312". Together, the teeth 286" and bolt apertures 312" are equally spaced along the circumference of the body 270" of the ring 30" with a gullet 128" being formed between each item. As shown in FIG. 19, both the teeth 286" and bolt apertures 312" are all located substantially the same radial distance from the axis 278".

The gullets 128" of the ring 30" each include a low point or bottom 336" that, when installed on a base 18, is below the top plane 96. In the illustrated embodiment, the bottom 336" of the gullet 128" is coincident with the top surface 296" of the body 270". Furthermore, the illustrated ring 30" includes the same number of gullets 128" as the number of gaps 208 in the dome 26. In alternative embodiments, the ring 30" may include a number of gullets 128" that is a multiple of the number of gaps 208.

The teeth 286" of the ring 30" are substantially rectangular in shape having a wider circumferential dimension than radial dimension. Each tooth 286" also narrows as it extends axially from the top surface 296" of the body 270". While the illustrated teeth 286" are rectangular, in alternative embodiments, different shapes may be used. In still other embodiments, the size and shape of the teeth 286" may vary on a single ring 30" (e.g., a portion of the teeth 286" are rectangular, a portion are diamond, and the like).

Figure 21:
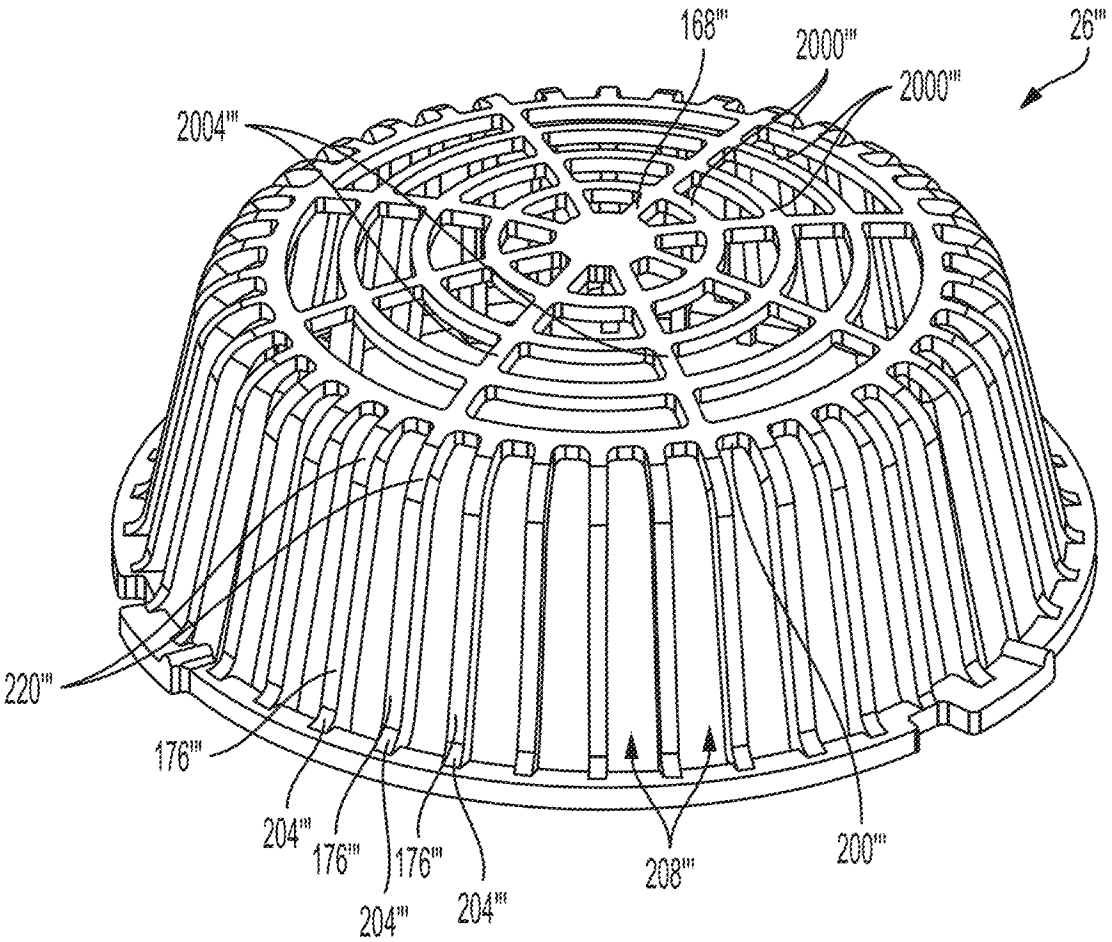
FIG. 21 is a perspective view of another embodiment of a dome.

FIG. 21 illustrates another embodiment of the dome 26"". The dome 26''' is substantially similar to the dome 26 so only the differences will be discussed herein. The core element 168''' of the dome 26''''' includes a plurality of concentric rings 2000'''' interconnected by a plurality of radially expending splines 2004''' to produce an outer core diameter 200'''''. The dome 26''' also includes a plurality of ribs 176''''' extending radially outwardly from the core element 168'''' to produce a corresponding distal end 204'''''. The dome 26'''' does not include any crossbeams outside the core element 168'''. Furthermore, the dome 26''' does not include any crossbeams proximate the transition 220''' of each rib 176". Stated differently, the gaps 208''' between each rib 176''' is not covered proximate the transition 220''''.

Figure 28:
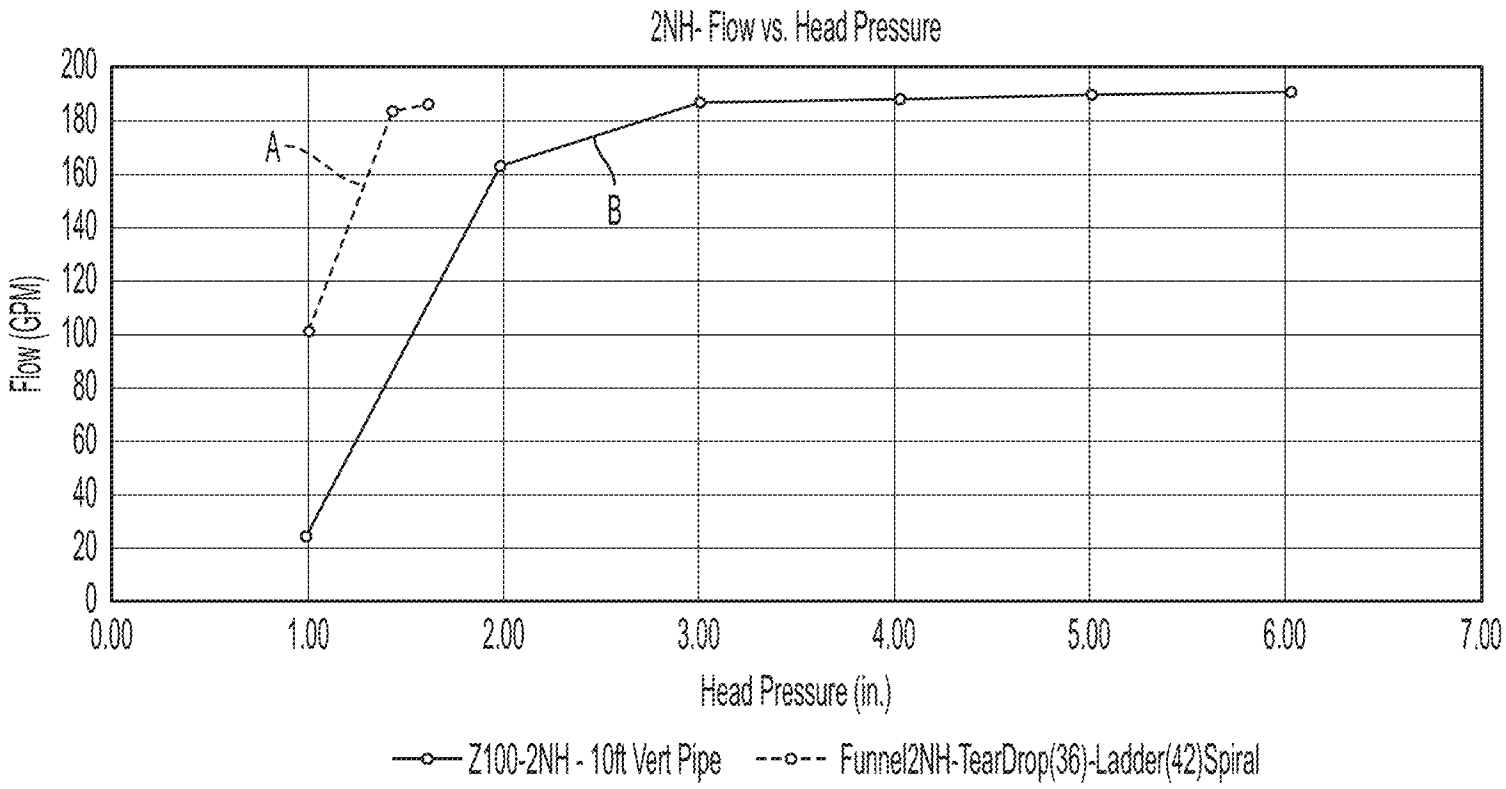
FIGS. 28-30 illustrate flow data generally corresponding to an embodiment of the roof drain.
Figure 29:
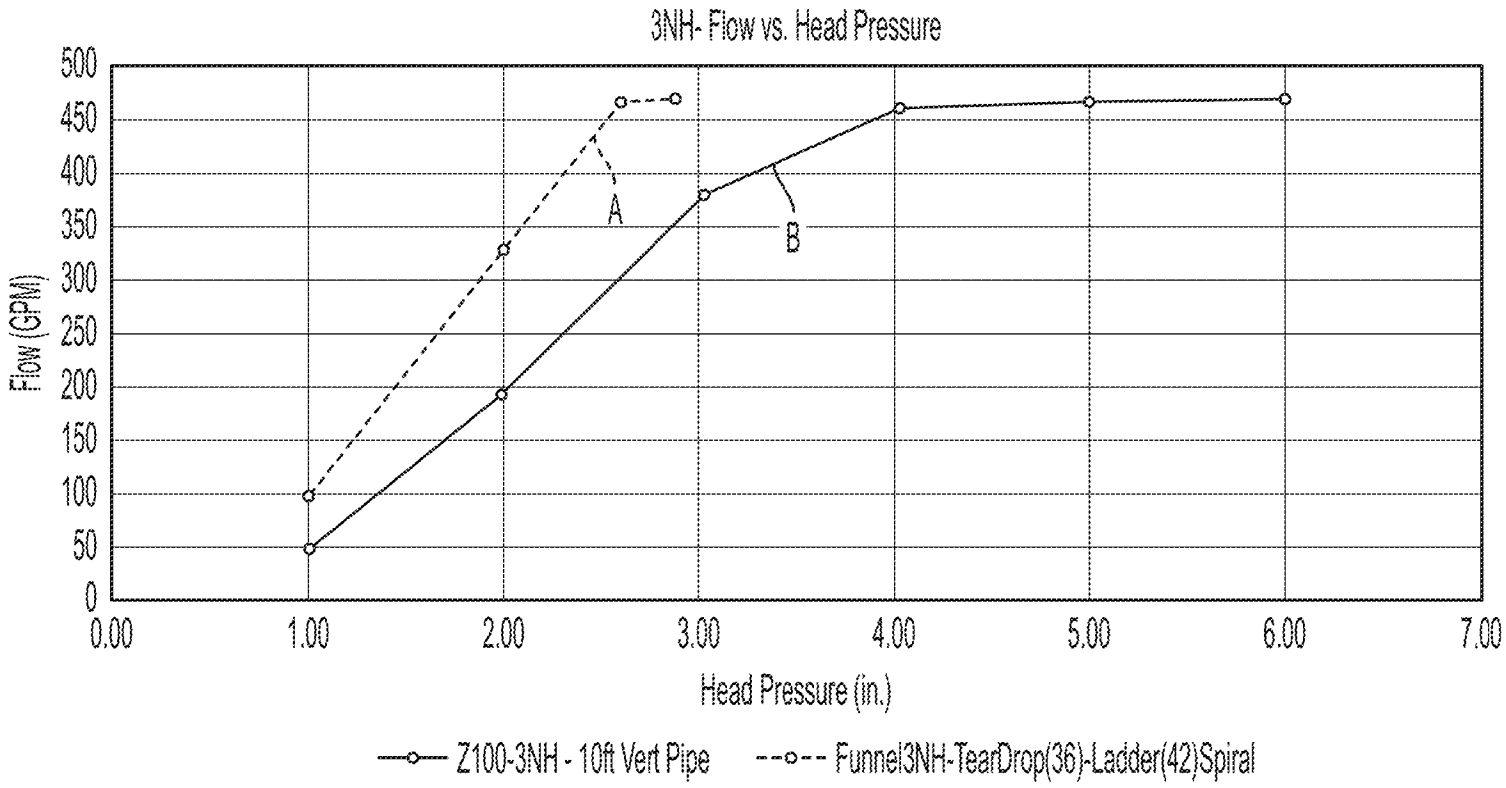
Figure 30:
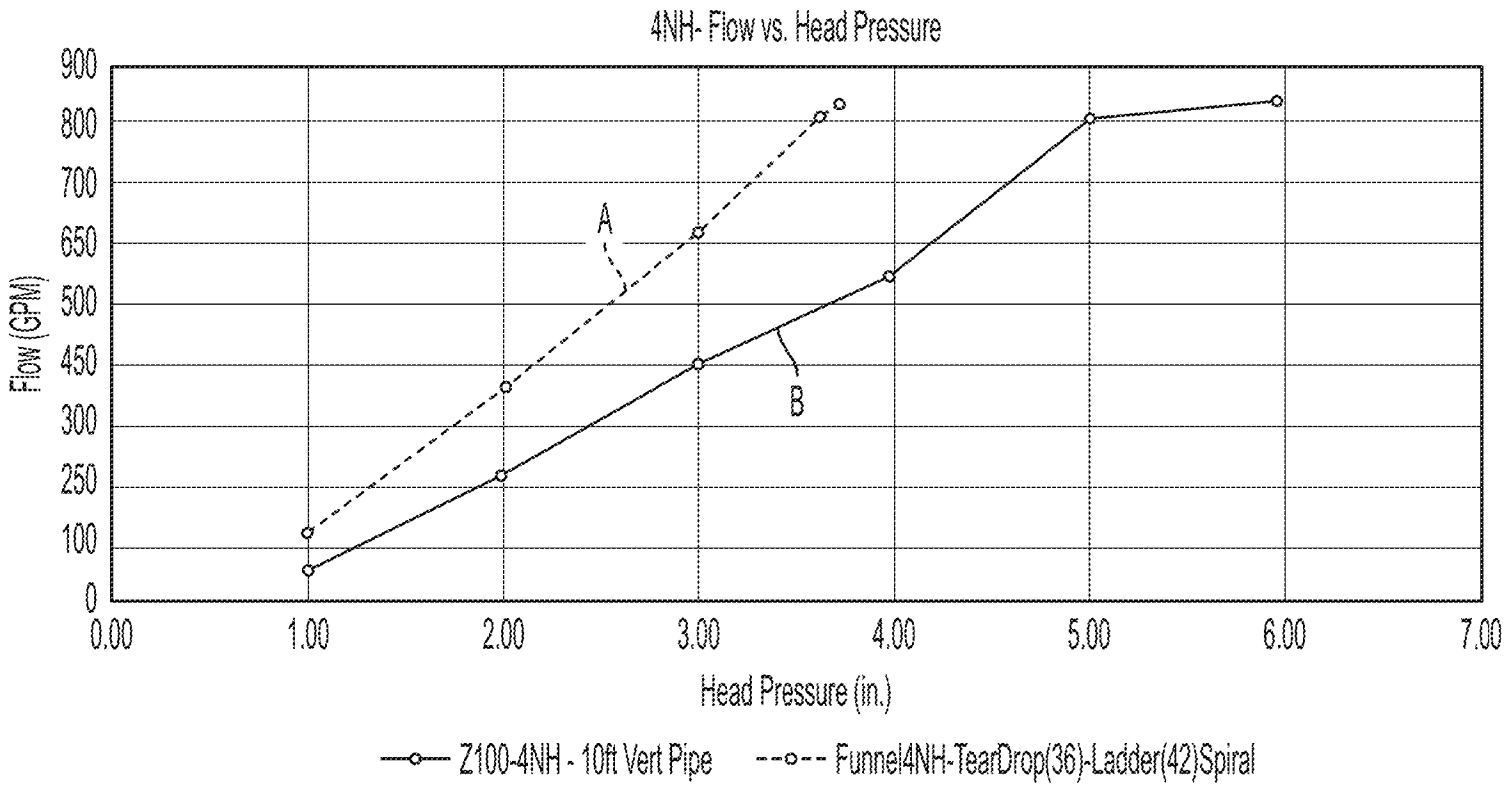
Figure 31:
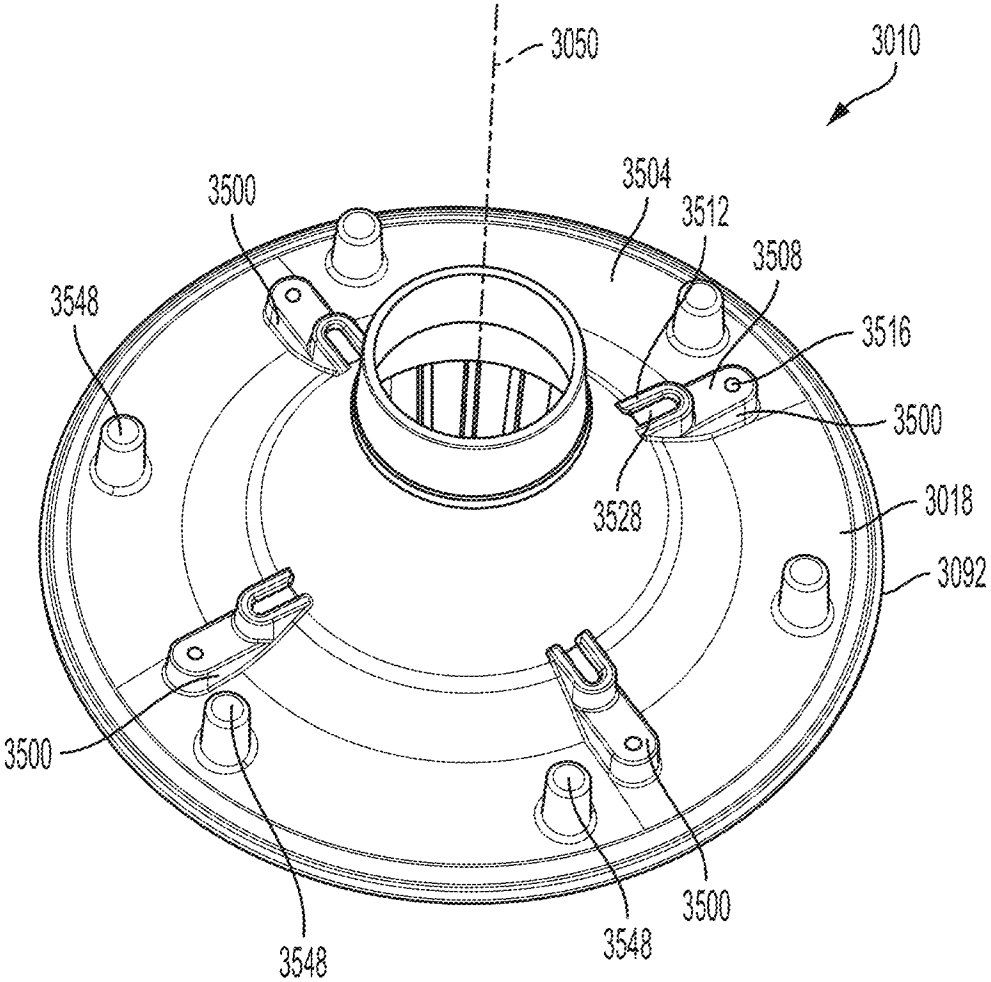
FIGS. 31-34 illustrate another embodiment of the roof drain.

FIGS. 28-30 illustrate the flow characteristics of some embodiments of the drain 10 (identified as line "A") as compared to a traditional roof drain (identified as line "B"). In some embodiments, the drain 10 is configured to flow between 75 and 150 GPM at 1" of head pressure. For the purposes of this application, the head pressure is measured as the depth of the water above the top plane 96 of the drain 10. In other embodiments, the drain 10 is configured to flow between 90 and 110 GPM at 1" of head pressure. In still other embodiments, the drain 10 is configured to flow between 75 and 100 GPM at 1" of head pressure. In still other embodiments, the drain 10 is configured to flow approximately 100 GPM at 1" of head pressure. In still other embodiments, the drain 10 is configured to flow at least 75 GPM at 1" of head pressure. In still other embodiments, the drain 10 is configured to flow at least 100 GPM at 1" of head pressure.

In still other embodiments, the drain 10 is configured to flow between 40 and 120 GPM at 1" of head pressure with an output diameter 24 of 2". In another embodiment, the drain 10 is configured to flow between 80 and 180 GPM at 1" of head pressure with an output diameter 24 of 2". In still other embodiments, the drain 10 is configured to flow between 90 and 110 GPM at 1" of head pressure with an output diameter 24 of 2". In still other embodiments, the drain 10 is configured to flow approximately 100 GPM at 1" of head with an output diameter 24 of 2".

In still other embodiments, the drain is configured to flow between 225 and 400 GPM at 2" of head pressure with an outlet diameter 24 of 4". In still other embodiments, the drain 10 is configured to flow between 225 and 375 GPM at 2" of head pressure with an outlet diameter 24 of 4". In still other embodiments, the drain 10 is configured to flow between 300 and 400 GPM at 2" of head pressure with an outlet diameter 24 of 4". In still other embodiments, the drain 10 is configured to flow between 350 and 400 GPM at 2" of head with an outlet diameter 24 of 4". In still other embodiments, the drain 10 is configured to flow approximately 350 GPM at 2" of head with an outlet diameter 24 of 4". In still other embodiments, the drain 10 is configured to flow greater than 225 GPM at 2" of head pressure with an outlet of 4". In still other embodiments, the drain 10 is configured to flow at least 250 GPM at 2" of head pressure with an outlet diameter of 4". In still another embodiment, the drain 10 is configured to flow at least 250 GPM at 2" of head with an outlet of at least 3".

In still other embodiments, the drain 10 is configured to flow between 200 and 350 GPM at 2" of head pressure with an outlet diameter 24 of 3". In still other embodiments, the drain 10 is configured to flow between 200 and 325 GPM at 2" of head pressure with an outlet diameter 24 of 3". In still other embodiments, the drain 10 is configured to flow between 300 and 400 GPM at 2" of head pressure with an outlet diameter 24 of 3". In still other embodiments, the drain 10 is configured to flow between 300 and 350 GPM at 2" of head pressure with an outlet diameter 24 of 3". In still other embodiments, the drain 10 is configured to flow approximately 325 GPM at 2" of head pressure with an outlet diameter of 3". In still other embodiments, the drain 10 is configured to flow greater than or equal to 325 GPM at 2" of head pressure with an outlet diameter of 3". In still other embodiments, the drain 10 is configured to flow at least 200 GPM at 2" of head pressure with an outlet diameter of 3".

In still other embodiments, the drain 10 is configured to reach 90% maximum flow rate at less than 2" of head pressure. For the purposes of this application, the maximum flow rate of the drain 10 is generally defined as the maximum rate of flow that can pass through the drain 10 having a downpipe with a diameter equal to the outlet diameter 24 of the outlet 22 attached thereto.

In still other embodiments, the drain 10 is configured to reach 90% maximum flow rate at less than 2" of head pressure with an outlet diameter of 2". In still other embodiments, the drain 10 is configured to reach 90% maximum flow rate at between 1" and 2" of head pressure with an outlet diameter of 2". In still other embodiments, the drain 10 is configured to reach 90% maximum flow rate at 1.5" of head pressure or less with an outlet diameter 24 of 2". In still other embodiments, the roof drain is configured to reach 90% maximum flow rate at less than 2" of head pressure with an outlet diameter of 2".

In still other embodiments, the drain 10 is configured to reach 90% maximum flow rate at less than 5" of head pressure with an outlet diameter 24 of 4". In still other embodiments, the drain 10 is configured to reach 90% maximum flow rate at between 3" and 4" of head pressure with an outlet diameter 24 of 4". In still other embodiments, the drain 10 is configured to reach 90% maximum flow rate at between 3.5" and 4" of head pressure with an outlet diameter 24 of 4". In still other embodiments, the drain 10 is configured to reach 90% maximum flow rate at approximately 3.5" of head pressure with an outlet diameter 24 of 4". In still other embodiments, the drain 10 is configured to reach 90% maximum flow rate at less than 4" of head pressure with an outlet diameter 24 of 4". In still other embodiments, the drain 10 is configured reach 90% maximum flow rate at less than 4.5" of head pressure with an outlet diameter of 4".

In still some embodiments, the drain 10 is configured to reach 90% maximum flow rate at less than 4" of head pressure with an outlet diameter 24 of 3". In still other embodiments, the drain 10 is configured to reach 90% maximum flow rate at less than 3" of head pressure with an outlet diameter 24 of 3". In still other embodiments, the drain 10 is configured to reach 90% maximum flow rate at between 2" and 3" of head pressure with an outlet diameter 24 of 3". In still other embodiments, the drain 10 is configured to reach 90% maximum flow rate at between 2.5" and 3" of head pressure with an outlet diameter 24 of 3". In still other embodiments, the drain 10 is configured to reach 90% maximum flow rate at approximately 2.5" of head pressure with an outlet diameter 24 of 3". In still other embodiments, the drain 10 is configured to reach 90% maximum flow rate at less than 3.5" of head pressure with an outlet diameter of 3".

In some embodiments, the flow rates set forth above may be determined by attaching a 10 foot long vertically oriented downpipe to the outlet 22 of the drain 10 and then running a test measuring the flow rate through the drain 10 and downpipe. In such embodiments, the 10 foot long vertically oriented downpipe would have a size substantially corresponding to the outlet diameter 24 of the drain 10. Furthermore, in some embodiments the roof drain may be installed in a test stand according industry standard ASME A112.6.4. Similarly, a test protocol to gather the data may also be conducted in accordance with ASME A112.6.4.

Figure 36:
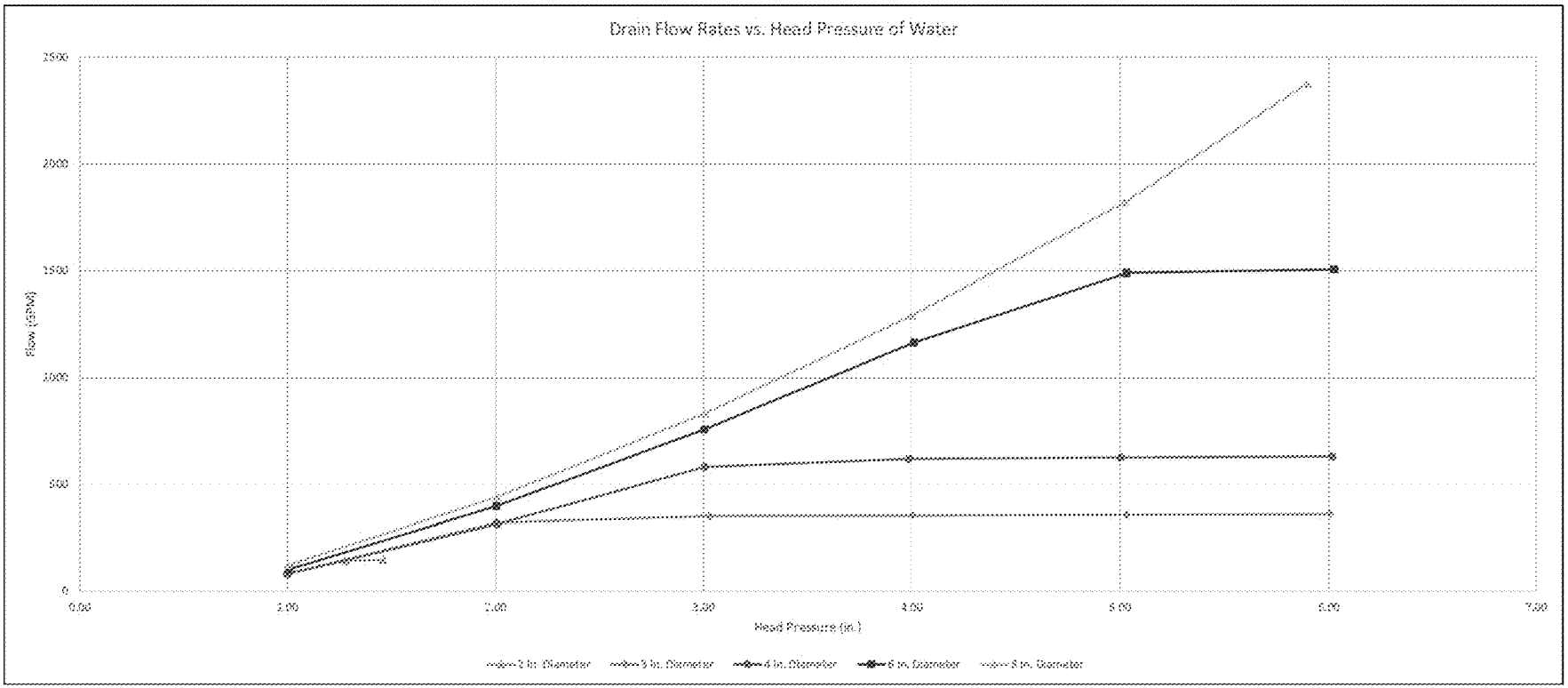

FIGS. 35 and 36 illustrate the flow characteristics of the drain 10 when tested having a 4 foot long vertically oriented drain pipe with the indicated output diameter attached thereto. The tests were conducted in accordance with standard ASME A112.6.4 as it pertains to gravity roof drains. The drain 10 is configured so that it will not transition from gravity flow characteristics to siphonic flow characteristics, under testing conditions, for at least 5 minutes. All head pressures are measured relative to the top plane 96.

In some embodiments, the drain 10 is configured to flow between 80 GPM and 125 GPM at 1 inch of head pressure. In still other embodiments, the drain 10 is configured to flow between 150 GPM and 445 GPM at 2 inches of head pressure. In still other embodiments, the drain 10 is configured to flow between 300 GPM and 350 GPM at 2 inches of head pressure. In still other embodiments, the drain 10 is configured to flow between 310 GPM and 330 GPM at 2 inches of head pressure.

In some embodiments, the drain 10 is configured to flow between 80 and 90 GPM at 1 inch of head pressure with an outlet diameter 24 of 2". In still other embodiments, the drain 10 is configured to flow approximately 85 GPM at 1 inch of head pressure with an outlet diameter 24 of 2". In still other embodiments, the drain 10 is configured to flow between 140 and 150 GPM with an outlet diameter 24 of 2". In still other embodiments, the drain 10 is configured to achieve 90% maximum flow at less than 1.5 inches of head pressure and an outlet diameter 24 of 2". In still other embodiments, the drain 10 is configured to achieve 90% maximum flow at less than 1.28 inches of head pressure and an outlet diameter 24 of 2".

In some embodiments, the drain 10 is configured to flow between 80 and 150 GPM at 1 inch of head pressure with an outlet diameter 24 of 3". In still other embodiments, the drain 10 is configured to flow approximately 81 GPM at 1 inch of head pressure with an outlet diameter 24 of 3". In still other embodiments, the drain 10 is configured to flow between 310 and 350 GPM at 2 inches of head pressure with an outlet diameter 24 of 3". In still other embodiments, the drain 10 is configured to flow approximately 320 GPM at 2 inches of head pressure with an outlet diameter 24 of 3". In still other embodiments, the drain 10 is configured to flow between 320 and 400 GPM with an outlet diameter 24 of 3". In still other embodiments, the drain 10 is configured to flow between 340 and 360 GPM with an outlet diameter 24 of 3". In still other embodiments, the drain 10 is configured to flow approximately 360 GPM with an outlet diameter 24 of 3". In still other embodiments, the drain 10 is configured to achieve 90% maximum flow at 2 inches or less of head pressure and an outlet diameter 24 of 3". In still other embodiments, the drain 10 is configured to achieve 90% maximum flow at 3 inches or less of head pressure and an outlet diameter 24 of 2".

In some embodiments, the drain 10 is configured to flow between 80 and 100 GPM at 1 inch of head pressure with an outlet diameter 24 of 4". In still other embodiments, the drain 10 is configured to flow approximately 81 GPM at 1 inch of head pressure with an outlet diameter 24 of 4". In still other embodiments, the drain 10 is configured to flow between 300 and 600 GPM at 2 inches of head pressure with an outlet diameter 24 of 4". In still other embodiments, the drain 10 is configured to flow between 300 and 350 GPM at 2 inches of head pressure with an outlet diameter 24 of 4". In still other embodiments, the drain 10 is configured to flow approximately 314 GPM at 2 inches of head pressure with an outlet diameter 24 of 4". In still other embodiments, the drain 10 is configured to flow between 600 and 650 GPM with an outlet diameter 24 of 4". In still other embodiments, the drain 10 is configured to flow between 620 and 350 GPM with an outlet diameter 24 of 4". In still other embodiments, the drain 10 is configured to flow approximately 630 GPM with an outlet diameter 24 of 4". In still other embodiments, the drain 10 is configured to achieve 90% maximum flow at 3 inches or less of head pressure and an outlet diameter 24 of 4".

In some embodiments, the drain 10 is configured to flow between 100 and 130 GPM at 1 inch of head pressure with an outlet diameter 24 of 6". In still other embodiments, the drain 10 is configured to flow approximately 102 GPM at 1 inch of head pressure with an outlet diameter 24 of 6". In still other embodiments, the drain 10 is configured to flow between 350 and 700 GPM at 2 inches of head pressure with an outlet diameter 24 of 6". In still other embodiments, the drain 10 is configured to flow between 375 and 425 GPM at 2 inches of head pressure with an outlet diameter 24 of 6". In still other embodiments, the drain 10 is configured to flow approximately 400 GPM at 2 inches of head pressure with an outlet diameter 24 of 6". In still other embodiments, the drain 10 is configured to flow between 1400 and 1600 GPM with an outlet diameter 24 of 6". In still other embodiments, the drain 10 is configured to flow approximately 1500 GPM with an outlet diameter 24 of 6". In still other embodiments, the drain 10 is configured to achieve 90% maximum flow at 4 inches or less of head pressure and an outlet diameter 24 of 6". In still other embodiments, the drain 10 is configured to achieve 90% maximum flow at 4.5 inches of head pressure and an outlet diameter 24 of 6".

In some embodiments, the drain 10 is configured to flow between 100 and 130 GPM at 1 inch of head pressure with an outlet diameter 24 of 8". In still other embodiments, the drain 10 is configured to flow approximately 122 GPM at 1 inch of head pressure with an outlet diameter 24 of 8". In still other embodiments, the drain 10 is configured to flow between 400 and 500 GPM at 2 inches of head pressure with an outlet diameter 24 of 8". In still other embodiments, the drain 10 is configured to flow between 420 and 480 GPM at 2 inches of head pressure with an outlet diameter 24 of 8". In still other embodiments, the drain 10 is configured to flow approximately 440 GPM at 2 inches of head pressure with an outlet diameter 24 of 8". In still other embodiments, the drain 10 is configured to flow between 2000 and 2500 GPM with an outlet diameter 24 of 8". In still other embodiments, the drain 10 is configured to flow approximately 2300 GPM with an outlet diameter 24 of 8". In still other embodiments, the drain 10 is configured to achieve 90% maximum flow at 5.5 inches or less of head pressure and an outlet diameter 24 of 8".

FIGS. 31-34 illustrate another embodiment of the drain 3010. The drain 3010 is substantially similar to the drain 10 so only the differences will be discussed in detail herein. The drain 3010 includes one or more bosses 3500 extending axially from the underside 3504 of the base 3018 of the drain 3010. Each boss 3500, in turn, defines a first surface 3508 oriented substantially perpendicular to the central axis 3050 of the base 3018, and a second surface 3512 oriented substantially perpendicular to the central axis 3050 and spaced axially from the first surface 3508. More specifically, the second surface 3512 is positioned axially below and radially inwardly of the first surface 3508.

Figure 32:
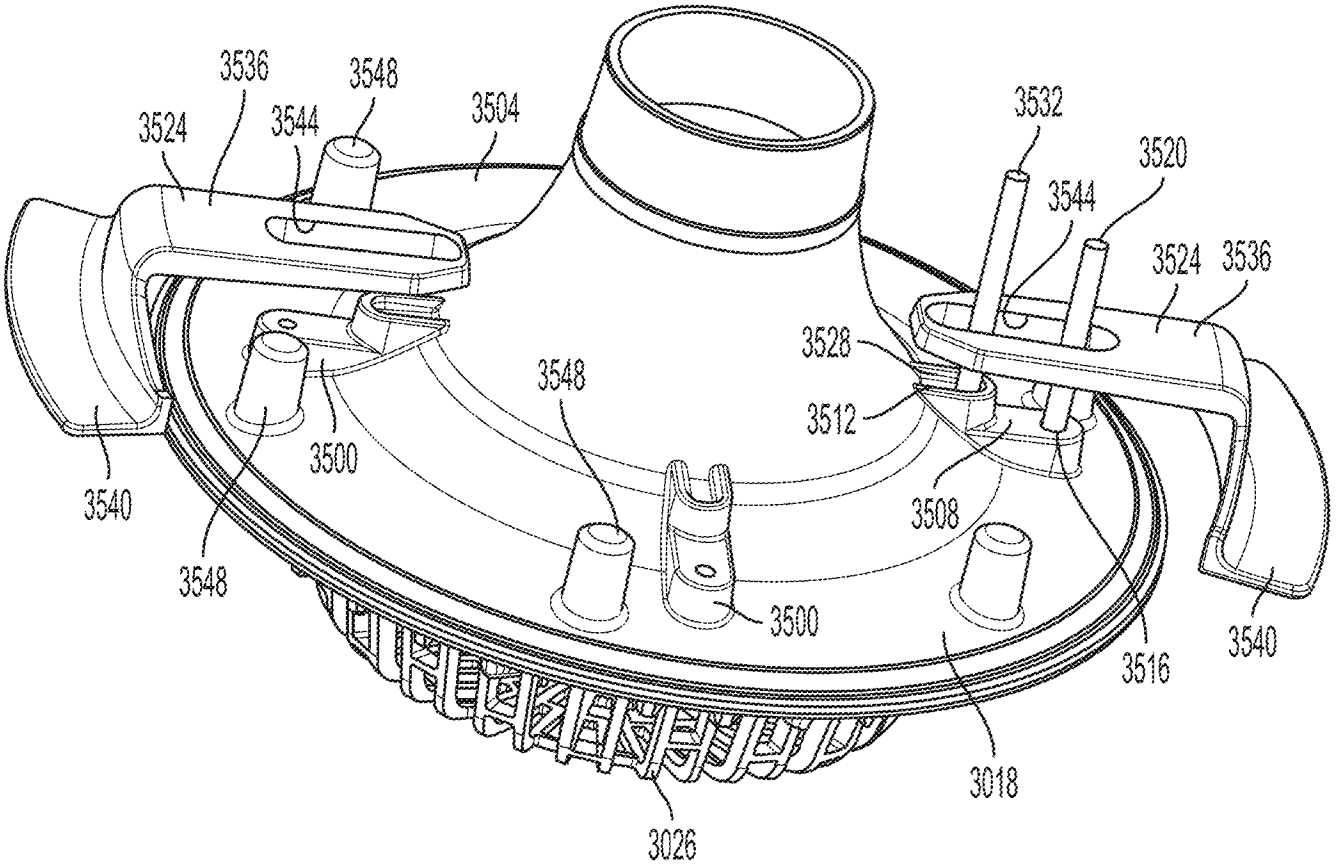

As shown in FIG. 32, the first surface 3508 defines a threaded aperture 3516 configured to receive a fastener 3520 therein for coupling a connection member 3524 to the base 3018. The second surface 3512, in turn, defines a slot 3528 radially aligned with the aperture 3516 of the first surface 3508. Together, the aperture 3516 and the slot 3528 help radially orient the connection member 3524 relative to the base 3018 of the drain 3010 by receiving a pin 3532 or other alignment member therein. While the illustrated drain 3010 includes four bosses 3500 formed therein, in alternative embodiments more or fewer bosses 3500 may be present.

The drain 3010 also includes one or more connection members 3524 configured to releasably secure the drain 3010 to a roof 14, alignment plate (not shown) or other support surface. Each connection member 3524 includes a first leg 3536 and a locking flange 3540. As shown in FIG. 32, the locking flange 3540 is radially and axially offset from the first leg 3536 and configured to contact the underside of the roof 14 or support surface. While the illustrated locking flange 3540 is substantially arcuate in shape, in other embodiments the flange 3540 may include teeth, texture, protrusions, and the like as necessary to interact with the underside of the support surface or roof 14.

As shown in FIG. 32, the first leg 3536 of the connection member 3524 defines an elongated slot 3544 sized to align with both the aperture 3516 and the slot 3528 of the boss 3500 and allow a fastener 3520 and/or pin 3532 to pass therethrough. The slot 3544 is configured to allow the connection member 3524 to be adjusted radially relative to the base 3018 during the installation process.

The drain 3010 also includes a plurality of stand-offs 3548 extending axially from the underside 3504 of the base 3018. The stand-offs 3548 are substantially cylindrical in shape and positioned equally along the outer edge 3092 of the base 3018. During use, the stand-offs 3548 are configured to engage the roof 14 or support surface and secure the base 3018 relative thereto.

Figure 33:
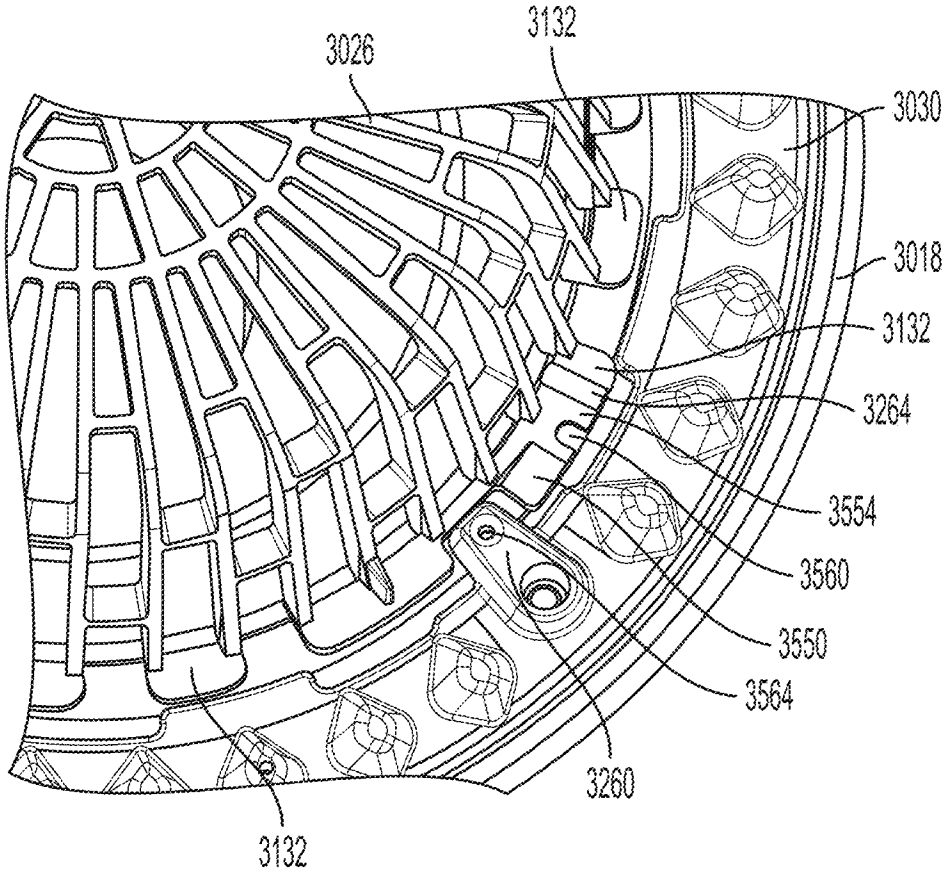
Figure 34:
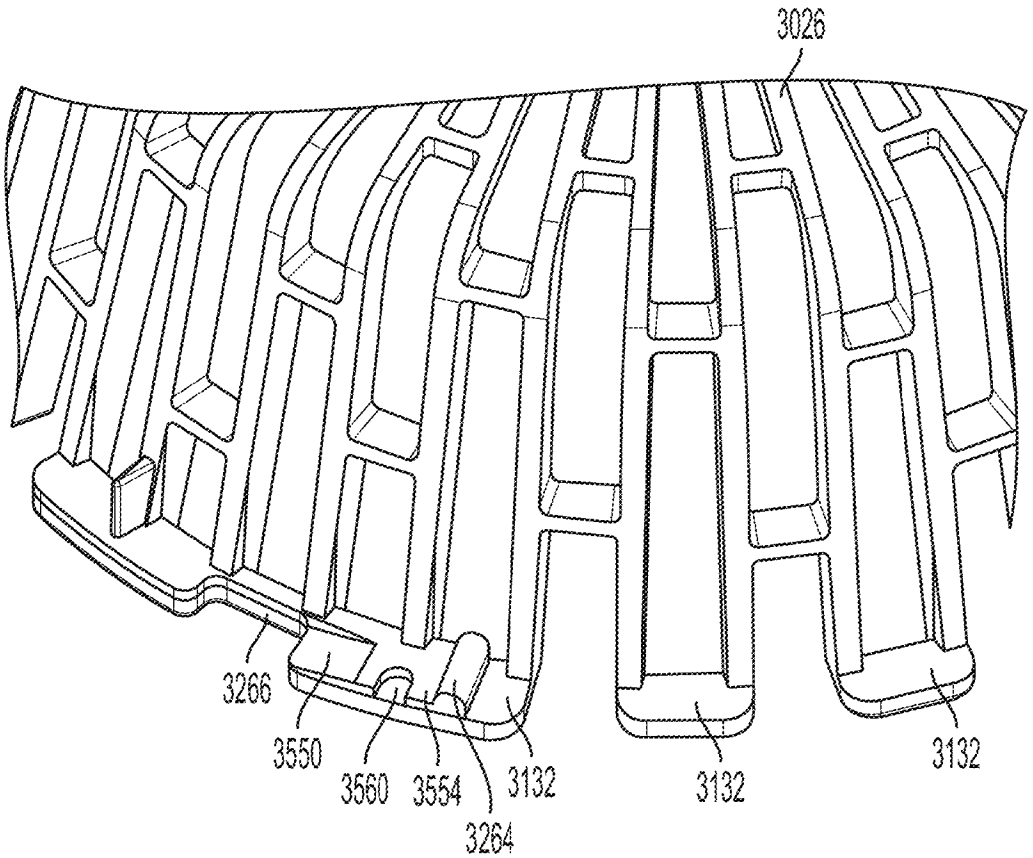

As shown in FIG. 33, the first set of base plates 3132 of the cage 3026 of the drain 3010 include a ramped surface 3550 configured to assist the locking member 3260 to travel up and onto the top of the base plate 3132 to engage the locking ridge 3264. More specifically, the ramped surface 3550 is formed into the base plates 3132 proximate the locking notch 3266 so that, when the user rotates the cage 3026 relative to the gravel ring 3030, the locking 3260 travels along the surface 3550 to the upper side 3554. This makes it easier for the user to lock the cage 3026 relative to the base 3018 and also allows for a tighter fit between the two elements 3026, 3018 once the connection has been made.

The first set of base plate 3132 also includes a locking notch 3560 formed into the upper side 3554 of the base plate 3132. When assembled, the locking notch 3560 substantially aligns with a corresponding aperture 3564 of the locking member 3260 such that the user may insert a fastener or pin through the aperture 3564 where it is at least partially received within the locking notch 3560 to rotational lock the cage 3026 relative to the ring 3030.

Although the invention has been described in detail with reference to certain preferred embodiments, variations and modifications exist within the scope and spirit of one or more independent aspects of the invention as described.

The invention claimed is:

1. A roof drain comprising:

a base including a throat portion having an outlet;

a gravel guard coupled to the base and including a plurality of teeth, a plurality of gullets positioned between the teeth;

at least one first locking member; and a dome including at least one second locking member engageable with the first locking member to releasably couple the dome to the base, the dome further including a plurality of ribs spaced apart from one another along a perimeter of the dome, the dome further including a plurality of crossbars extending between and interconnecting adjacent ribs in an alternating manner, the crossbars being offset from one another such that each crossbar is not aligned with each proximate crossbar with respect to a circumferential direction.

2. The roof drain of claim 1, wherein the base is positioned in an upper plane, and wherein at least one gullet of the plurality of gullets at least partially extends axially below the upper plane.

3. The roof drain of claim 1, wherein the base is positioned in an upper plane, wherein the dome includes a plurality of base plates extending between at least two adjacent ribs, and wherein at least one base plate of the plurality of base plates is positioned completely axially below the upper plane.

4. The roof drain of claim 1, wherein the throat portion includes an inner surface, and wherein the inner surface is substantially convex in shape.

5. The roof drain of claim 1, wherein the base includes a cutting groove.

6. The roof drain of claim 5, wherein the cutting groove is positioned radially inward of an outer diameter of the dome.

7. The roof drain of claim 1, wherein the base defines an upper plane, and wherein the roof drain is capable of permitting through-flows of between 75 GPM and 150 GPM at 1 inch of head pressure measured relative to the upper plane.

8. The roof drain of claim 1, wherein each gullet is radially aligned with a corresponding gap.

9. The roof drain of claim 1, wherein at least one gap between adjacent ribs is open at a lower end of the dome.

10. The roof drain of claim 1, wherein the at least one first locking member is positioned on the gravel guard.

* * * * *